US011137197B2

(12) United States Patent
Hickman et al.

(10) Patent No.: US 11,137,197 B2
(45) Date of Patent: Oct. 5, 2021

(54) FREEZER BLAST CELL FABRIC ROLL UP DOOR

(71) Applicant: Steel Works and Supply, Inc., Angier, NC (US)

(72) Inventors: Daniel Edward Hickman, Coats, NC (US); Daniel Edward Hickman, II, Angier, NC (US); Jeffrey Dale Hickman, Fuquay-Varina, NC (US)

(73) Assignee: STEEL WORKS AND SUPPLY, INC., Angier, NC (US)

( * ) Notice: Subject to any disclaimer, the term of this patent is extended or adjusted under 35 U.S.C. 154(b) by 0 days.

(21) Appl. No.: 15/834,543

(22) Filed: Dec. 7, 2017

(65) Prior Publication Data

US 2018/0100683 A1 Apr. 12, 2018

Related U.S. Application Data

(63) Continuation of application No. 15/001,580, filed on Jan. 20, 2016, now abandoned.

(60) Provisional application No. 62/105,823, filed on Jan. 21, 2015.

(51) Int. Cl.

| | |
|---|---|
| ***E06B 9/58*** | (2006.01) |
| ***F25D 23/02*** | (2006.01) |
| ***E06B 9/17*** | (2006.01) |
| ***E06B 9/13*** | (2006.01) |
| ***F25D 13/00*** | (2006.01) |
| *E06B 9/80* | (2006.01) |

(52) U.S. Cl.

CPC ..... *F25D 23/02* (2013.01); *E06B 9/13* (2013.01); *E06B 9/17046* (2013.01); *E06B 9/581* (2013.01); *F25D 13/00* (2013.01); *F25D 23/028* (2013.01); *E06B 2009/805* (2013.01)

(58) Field of Classification Search

CPC ..... F25D 13/00; F25D 13/02; E06B 9/581; E06B 9/58; E06B 9/54; E06B 9/805; E06B 9/804; E06B 9/801; E06B 9/80

See application file for complete search history.

(56) References Cited

U.S. PATENT DOCUMENTS

| | | | | |
|---|---|---|---|---|
| 1,871,141 A * | 8/1932 | Baker | E06B 9/78 | 160/267.1 |
| 3,292,685 A * | 12/1966 | Clark | E06B 9/13 | 160/26 |
| 3,797,553 A * | 3/1974 | Elliott | E06B 9/582 | 160/267.1 |
| 3,888,345 A * | 6/1975 | Mitchell | B65G 45/20 | 198/494 |
| 5,392,835 A * | 2/1995 | Wildt | E06B 9/17007 | 160/120 |
| 6,574,832 B1 * | 6/2003 | Boerger | E06B 9/581 | 16/90 |

(Continued)

*Primary Examiner* — Colleen M Chavchavadze
*Assistant Examiner* — Jeremy C Ramsey
(74) *Attorney, Agent, or Firm* — FisherBroyles. LLP; Keats Quinalty

(57) ABSTRACT

A freezer blast cell fabric roll up door is disclosed, wherein the freezer blast cell fabric roll up door is built to reliably withstand the high velocity wind loads and harsh freezing environments of a blast freezer. In one example, the presently disclosed freezer blast door comprises a drive or main assembly that further comprises a head plate bracket assembly, a brush bar assembly, a barrel assembly, a guide assembly, and a curtain assembly.

12 Claims, 35 Drawing Sheets

(56) References Cited

U.S. PATENT DOCUMENTS

| | | | | |
|---|---|---|---|---|
| 2011/0198901 | A1* | 8/2011 | Kaiser | B60J 1/2036<br>297/217.1 |
| 2013/0112358 | A1* | 5/2013 | Hardison, III | E06B 9/86<br>160/340 |

* cited by examiner

107

| ITEM NO. | PART NUMBER | DESCRIPTION | QTY. |
|---|---|---|---|
| 110 | 48IN TOP ANGLE | | 1 |
| 115 | DRIVE SIDE HEAD PLATE ASSEMBLY | | 1 |
| 120 | RHSSNBOLT 0.5-13X1.75X1.25-N | Carrriage Bolt 1/2x13x1 3/4 | 6 |
| 125 | PREFERRED NARROW FW 0.5 | Narrow Flat Washer 1/2 | 6 |
| 130 | REGULAR LW 0.5 | Regular Lock Washer 1/2 | 6 |
| 135 | HJNUT 0.5000-13-D-N | Hex Jam Nut 1/2 x 13 | 6 |
| 140 | HJNUT 0.3750-16-D-N | Hex Jam Nut 3/8 x 16 | 6 |
| 145 | 48IN TOP ANGLE LS | | 1 |
| 150 | TENSION SIDE HEAD PLATE ASSEMBLY | | 1 |
| 155 | BRUSH BAR ASSEMBLY | | 1 |
| 160 | BARREL ASSEMBLY | | 1 |
| 165 | TOP TRACK SECTION | | 1 |
| 170 | HBOLT 0.3750-16X1X1-N | Hex Bolt 3/8 x 16 x 1 | 4 |
| 175 | TOP TRACK SECTION RIGHT SIDE | | 1 |
| 180 | 60IN GUIDE ASSEMBLY | | 10 |

FIG. 3

| ITEM NO. | PART NUMBER | DESCRIPTION | QTY. |
|---|---|---|---|
| 210 | NEW HEAD PLATE WITH CHAIN HOIST MOUNT | | 1 |
| 215 | BROWNING BEARING | | 1 |
| 220 | PREFERRED NARROW FW 0.5 | Narrow Flat Washer 1/2 | 4 |
| 225 | HBOLT 0.5000-13X1.75X1.25-N | Hex Bolt 1/2 x 13 x 1 3/4 | 4 |
| 230 | REGULAR LW 0.5 | Regular Lock Washer 1/2 | 4 |
| 235 | REGULAR LW 0.375 | Regular Lock Washer 3/8 | 2 |
| 240 | HHJNUT 0.5000-13-D-N | Hex Jam Nut 1/2 x 13 | 3 |
| 245 | HHJNUT 0.5000-13-B-N | Hex Jam Nut 1/2 x 13 | 1 |
| 250 | HHJNUT 0.3750-16-D-N | Hex Jam Nut 3/8 x 16 | 2 |
| 255 | 1IN BEARING | | 1 |
| 260 | RHSNBOLT 0.375-16X1X1-N | Carriage Bolt 3/8 x 16 x 1 | 2 |

305

| ITEM NO. | PART NUMBER | DESCRIPTION | QTY. |
|---|---|---|---|
| 310 | NEW HEAD PLATE | | 1 |
| 315 | PLATE FOR WC | | 1 |
| 320 | RHSSNBOLT 0.5-13X1.5X1.25-N | Carriage Bolt 1/2 x 13 x 1 1/2 | 4 |
| 325 | RHSNBOLT 0.375-16X1X1-N | Carriage Bolt 3/8 x 16 x 1 1/2 | 2 |
| 330 | PR6EFERRED NARROW FW 0.5 | 1/2" Flat Washer | 4 |
| 335 | REGULAR LW 0.5 | 1/2" Lock Washer | 4 |
| 340 | REGULAR LW 0.375 | 3/8" Lock Washer | 2 |
| 345 | HHJNUT 0.5000-13-D-N | Hex Head Jam Nut 1/2 x 13 | 4 |
| 350 | HHJNUT 0.3750-16-D-N | Hex Head Jam Nut 3/8 x 16 | 2 |
| 355 | 1IN BEARING | | 1 |

| ITEM NO | PART NUMBER | DESCRIPTION | QTY. |
|---|---|---|---|
| 410 | 4IN SQ TUBE 120IN | | 1 |
| 415 | BRUSH RETAINER | | 4 |
| 420 | FHTS 0.3125-12-AB-1.83-N | 1/2" x 1 Hex Head Self Tapping Screws | 36 |
| 425 | BRUSH | | 4 |
| 430 | SHAFT ASSEMBLY DRIVE SIDE | | 1 |
| 435 | SHAFT ASSEMBLY | | 1 |
| 440 | 9414T19 | 1" Set Collar | 2 |

505

| ITEM NO | PART NUMBER | DESCRIPTION | QTY. |
|---|---|---|---|
| 4301 | BRUSH BAR INNER CAPS | | 2 |
| 4302 | 51-1.133P12T12S03.0H2.0L 1.0000S1 | Finished Bore Sprocket 50B12 x 1" | 1 |
| 4303 | 1IN SHAFT WITH KEY WAY | | 1 |
| 4304 | 250 X 2 KEY | | 1 |

605

| ITEM NO | PART NUMBER | DESCRIPTION | QTY. |
|---|---|---|---|
| 4301 | 1IN SHAFT | | |
| 4303 | BRUSH BAR INNER CAPS | | |

705

| ITEM NO | PART NUMBER | DESCRIPTION | QTY. |
|---|---|---|---|
| 700 | BARREL | 10.750 OD WITH.188 WALL X 120" LONG | 1 |
| 715 | CURTAIN RETAINER | | 1 |
| 720 | RHBOLT 0.375-16X0.75X0.75-N | Hex Bolt 3/8 x 16 x 3/4 | 9 |
| 725 | SPRING ASSEMBLY | | 1 |
| 730 | WINDING COG | | 1 |
| 735 | HBOLT 0.3750-16X2.5X2.5-N | Hex Bolt 3/8 x 16 x 2 1/2 Bolt | 1 |
| 740 | HJNUT 0.3750-16-N | 3/8 x 16 Locking Nut | 1 |
| 745 | WINDING COG ANGLE | | 1 |
| 750 | WINDING COG ANGLE PIN | | 1 |
| 755 | DRIVE SIDE ASSEMBLY | | 1 |

805

| ITEM NO | PART NUMBER | DESCRIPTION | QTY. |
|---|---|---|---|
| 810 | TORSION SPRING | | 1 |
| 815 | SPRING PLATE | | 1 |
| 820 | TENSION SIDE SHAFT | | 1 |
| 825 | BARREL END CAP TENSION SIDE | | 1 |
| 830 | BROWNING BEARING | | 1 |
| 835 | REGULAR LW 0.5 | 1/2" Lock Washer | 4 |
| 840 | HBOLT 0.5000-13x0.5x0.5-N | Hex Bolt 1/2 x 13 x 1 1/2 | 4 |

905

| ITEM NO. | PART NUMBER | DESCRIPTION | QTY. |
|---|---|---|---|
| 910 | DRIVE SIDE SHAFT | 1.25 OD WITH 1/4" KEYWAY | 1 |
| 915 | BARREL END PLATE | | 2 |
| 920 | 51-1.133P15T15SO3.0H2.0L 1.2500S1 | Finished Bore Sprocket 50B18 x 1 1/4 | 1 |
| 925 | 51-1.133P20T20SO3.0H2.0L 1.2500S1 | Finished Bore Sprocket 50B40 x 1 1/4 | 1 |
| 926 | .250 X 2 KEY | | 2 |

1005

| ITEM NO. | PART NUMBER | DESCRIPTION | QTY. |
|---|---|---|---|
| 1010 | REAR GUIDE ANGLE | | 1 |
| 1015 | GUIDE FACE | | 2 |
| 1020 | HINGE BODY | | 2 |
| 1025 | HINGE BASE ASSEMBLY | | 2 |
| 1030 | HBOLT 0.3750-16x1x1-N | Hex Bolt 3/8 x 16 x 1 | 2 |
| 1035 | HJNUT 0.3750-16 D-N | Hex Jam Nut 3/8 x 16 x 1 | 2 |

1105

| ITEM NO. | PART NUMBER | DESCRIPTION | QTY. |
|---|---|---|---|
| 1020 | HINGE BODY | | 1 |
| 1115 | HINGE PIN | | 1 |

FREEZER BLAST CELL FABRIC ROLL UP DOOR

CROSS-REFERENCE TO RELATED APPLICATIONS

This application is a continuation application of U.S. Utility patent application Ser. No. 15/001,580, filed Jan. 20, 2016, which claims the benefit of U.S. Provisional Application No. 62/105,823, filed Jan. 21, 2015, the entire contents of which are incorporated by reference herein in their entireties.

TECHNICAL FIELD

The presently disclosed subject matter relates generally to blast freezers, and more particularly to a freezer blast cell fabric roll up door.

BACKGROUND

A blast freezer is designed to rapidly ramp down the temperature of foods and goods, freezing them extremely quickly. Blast freezers operate with blowers forcing chilled air over product to rapidly cool them down. Blast freezers in the meat/processing industry are typically very large, capable of holding multiple pallets, (several thousand pounds of product), per freeze cycle. Blast freezers use a lot of energy and high volume circulating air. However, in current blast freezers there can be reliability issues with respect to the components thereof being able to withstand high velocity wind loads and the harsh freezing environments.

BRIEF DESCRIPTION OF THE DRAWINGS

Figure 1:
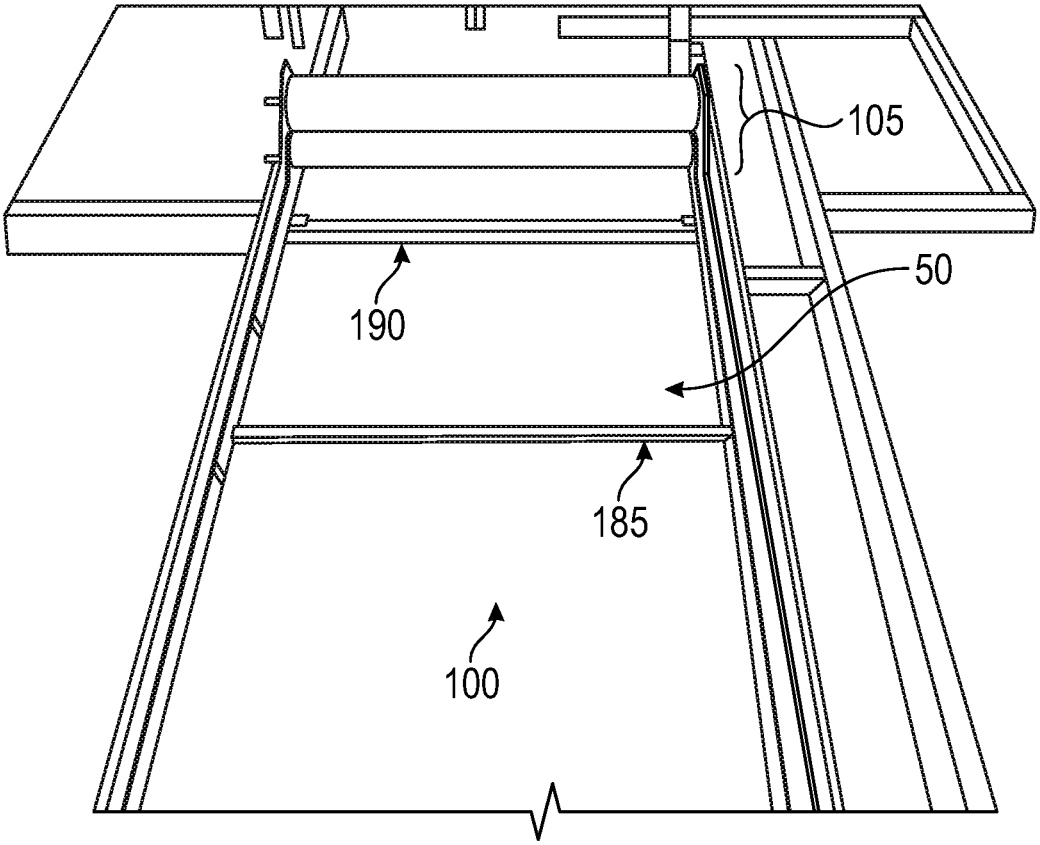
Figure 33A:
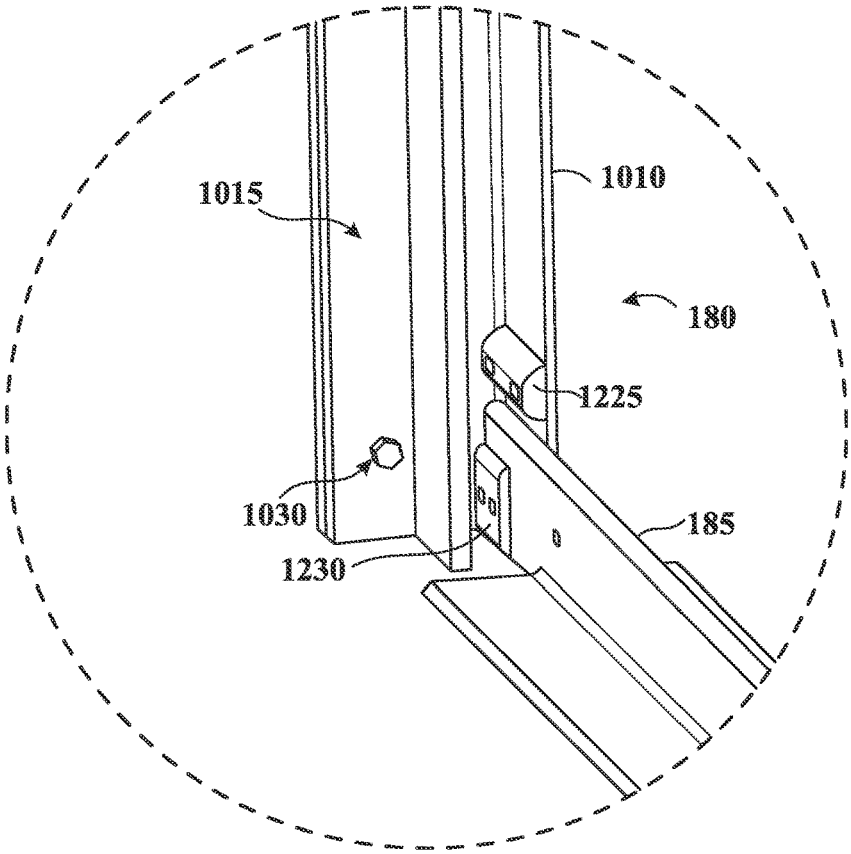
Figure 33B:
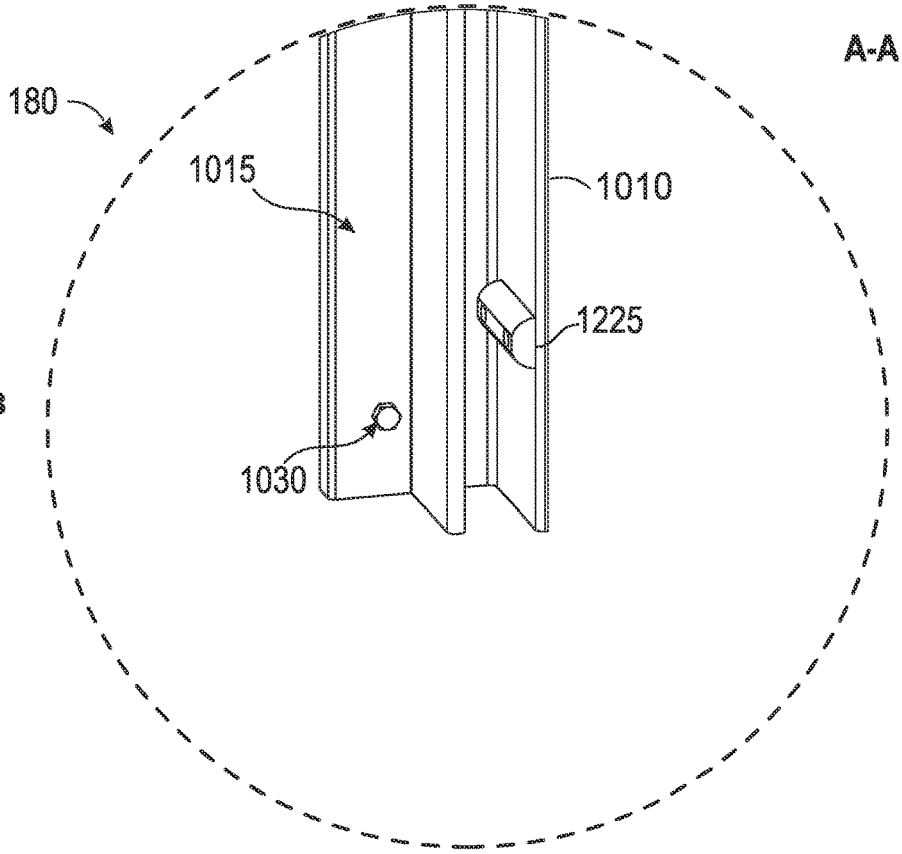

Having thus described the presently disclosed subject matter in general terms, reference will now be made to the accompanying Drawings, which are not necessarily drawn to scale, and wherein:

FIG. 1 illustrates a perspective view of an example of the presently disclosed freezer blast cell fabric roll up door;

FIG. 2 through FIG. 6 show various views of a drive or main assembly of the presently disclosed freezer blast cell fabric roll up door;

FIG. 7 through FIG. 12B show various views of a head plate bracket assembly of the presently disclosed freezer blast cell fabric roll up door;

FIG. 13 through FIG. 18 show various views of a brush bar assembly of the presently disclosed freezer blast cell fabric roll up door;

FIG. 19 through FIG. 26 show various views of a barrel assembly of the presently disclosed freezer blast cell fabric roll up door;

FIG. 27 through FIG. 32B show various views of a guide assembly of the presently disclosed freezer blast cell fabric roll up door;

FIG. 33A shows a perspective view of one corner of the lower portion of the left side guide assembly;

FIG. 33B shows detail of the left side guide assembly without bottom bar 185.

Figure 34B:
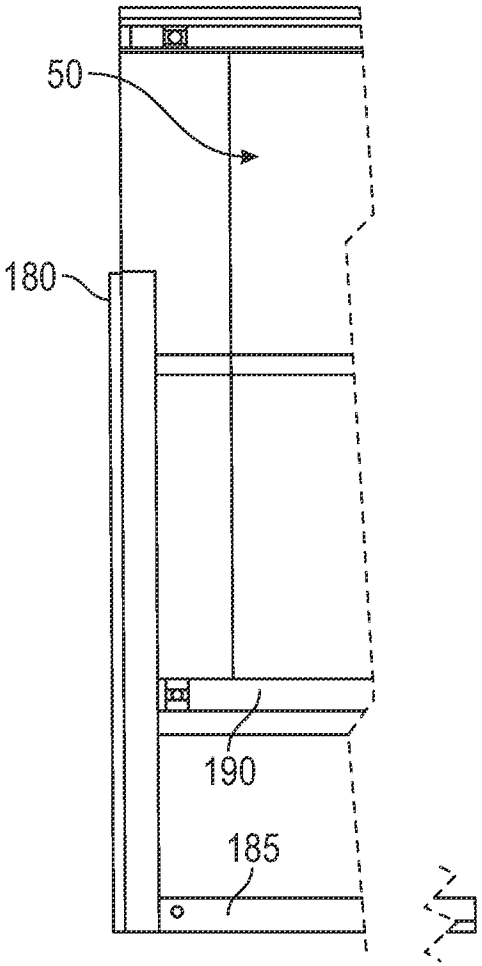
Figure 34A:
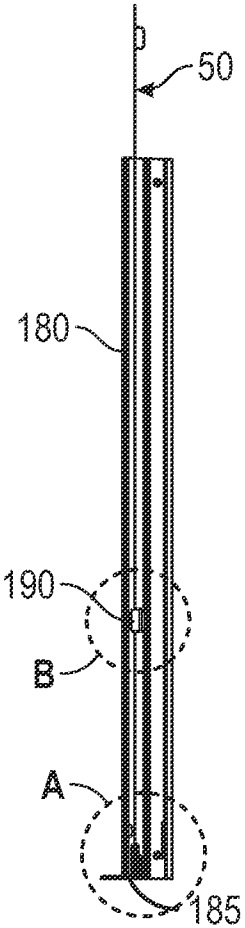
Figure 35B:
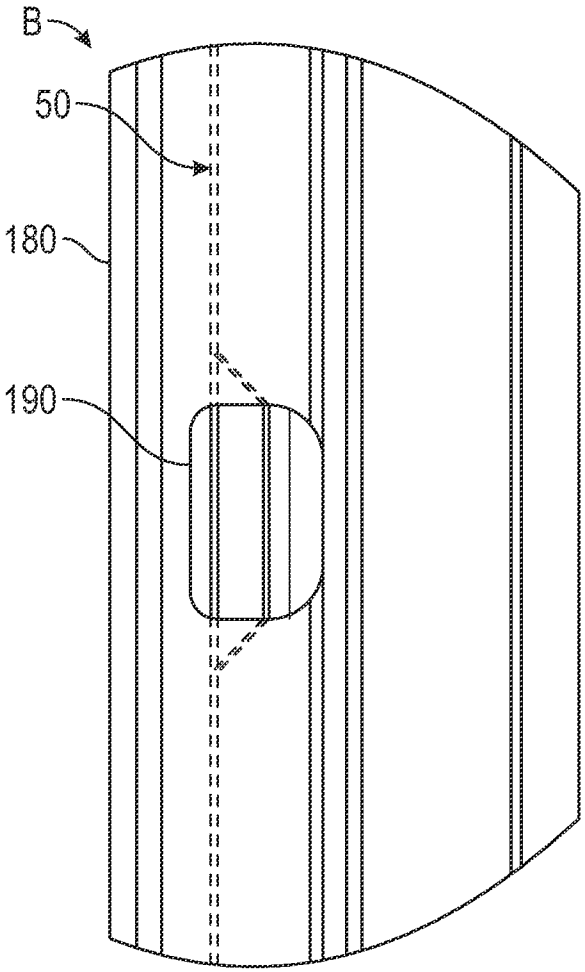
Figure 35A:
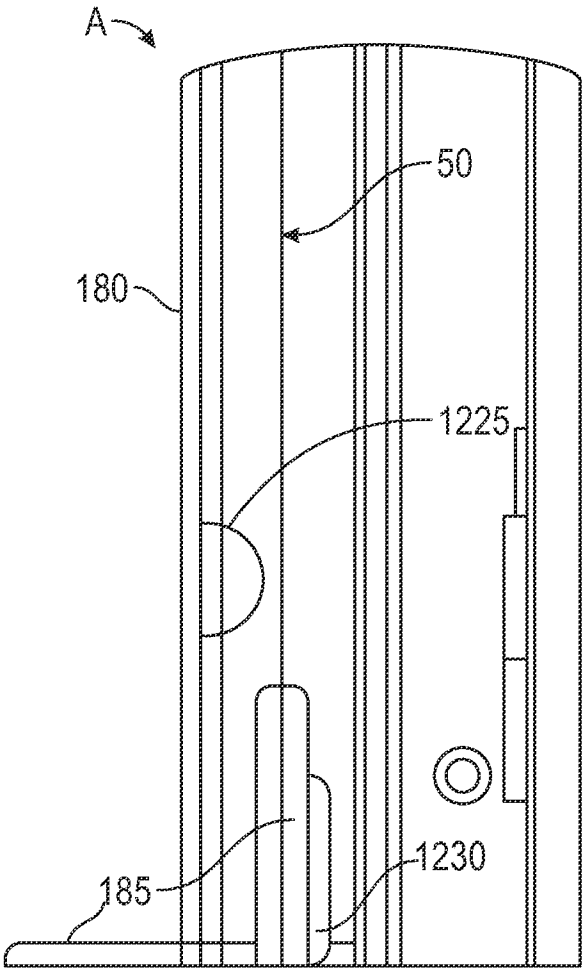

FIGS. 34A and B show side and front views of the guide assembly, bottom bar assembly, and horizontal pockets of the presently disclosed freezer blast cell fabric roll up door; and FIGS. 35A and B show detailed views of portions of the side views of FIGS. 34A and B, particularly in FIG. 34A the guide assembly, bottom bar assembly, and half-round catch block, and in FIG. 34B the horizontal pockets of the presently disclosed freezer blast cell fabric roll up door.

SUMMARY

The presently disclosed subject matter provides a freezer blast cell fabric roll up door assembly comprising a drive assembly, a head plate bracket assembly, a brush bar assembly, a barrel assembly, a guide assembly; and a curtain assembly, wherein the guide assembly further comprises: a) a formed edge that interlocks with wind locks on the curtain assembly when wind loads exceed a certain threshold; and b) a hold down feature disposed at a bottom portion of the guide assembly that receives a bottom bar assembly disposed at a lower end of the curtain assembly, thereby preventing the door from rising off the ground when wind loads are applied.

In certain aspects. the brush bar assembly comprises one or more brushes coupled to a bar, wherein the one or more brushes have a length substantially equal to the width of the curtain assembly, and further wherein when the door is opened or closed at a certain speed, the brush bar assembly rotates at a speed greater than the speed of the moving door, thereby brushing excess frost off the door as it opens or closes.

In additional aspects, the curtain assembly further comprises horizontal pockets 190, particularly wherein the curtain assembly further comprises stiffener bars in the horizontal pockets 190 (see FIGS. 1, 34A and B and 35B).

In other aspects, the barrel assembly further comprises a torsion spring coupled to the curtain assembly such that the torsion spring counter balances the curtain assembly, making the curtain assembly easier to raise and lower.

In a further aspect, the hold down feature comprises: a) a lower portion of the guide assembly a bottom bar; b) a first guide rail and a second guide rail are arranged on edge along the length of the bottom bar assembly; c) half-round catch blocks are provided on the face of the first guide rail and/or the second guide rail; wherein the bottom bar assembly disposed at the lower end of the curtain falls in under the half-round catch blocks when the curtain is lowered, and wherein a wind load causes the bottom bar assembly to go under the half-round catch blocks to lock the curtain in a down position.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides a freezer blast cell fabric roll up door, wherein the freezer blast cell fabric roll up door is built to reliably withstand the high velocity wind loads and harsh freezing environments of a blast freezer. In one example, the presently disclosed freezer blast door comprises a drive or main assembly that further comprises (1) a head plate bracket assembly, (2) a brush bar assembly, (3) a barrel assembly, (4) a guide assembly, and (5) a curtain assembly.

Referring now to FIG. 1 a perspective view of an example of the presently disclosed freezer blast cell fabric roll up door 100 is shown that comprises a drive or main assembly that further comprises (1) a head plate bracket assembly, (2) a brush bar assembly, (3) a barrel assembly, (4) a guide assembly, and (5) a curtain assembly.

Referring now to FIG. 2 through FIG. 6, various views of a drive or main assembly 105 of the presently disclosed freezer blast cell fabric roll up door are shown. The drive assembly 105 can include any components commonly used in the industry for opening and closing overhead roll up doors, such as, for example, a chain-hoist, motor operators, counter weight, and the like.

Figure 2:
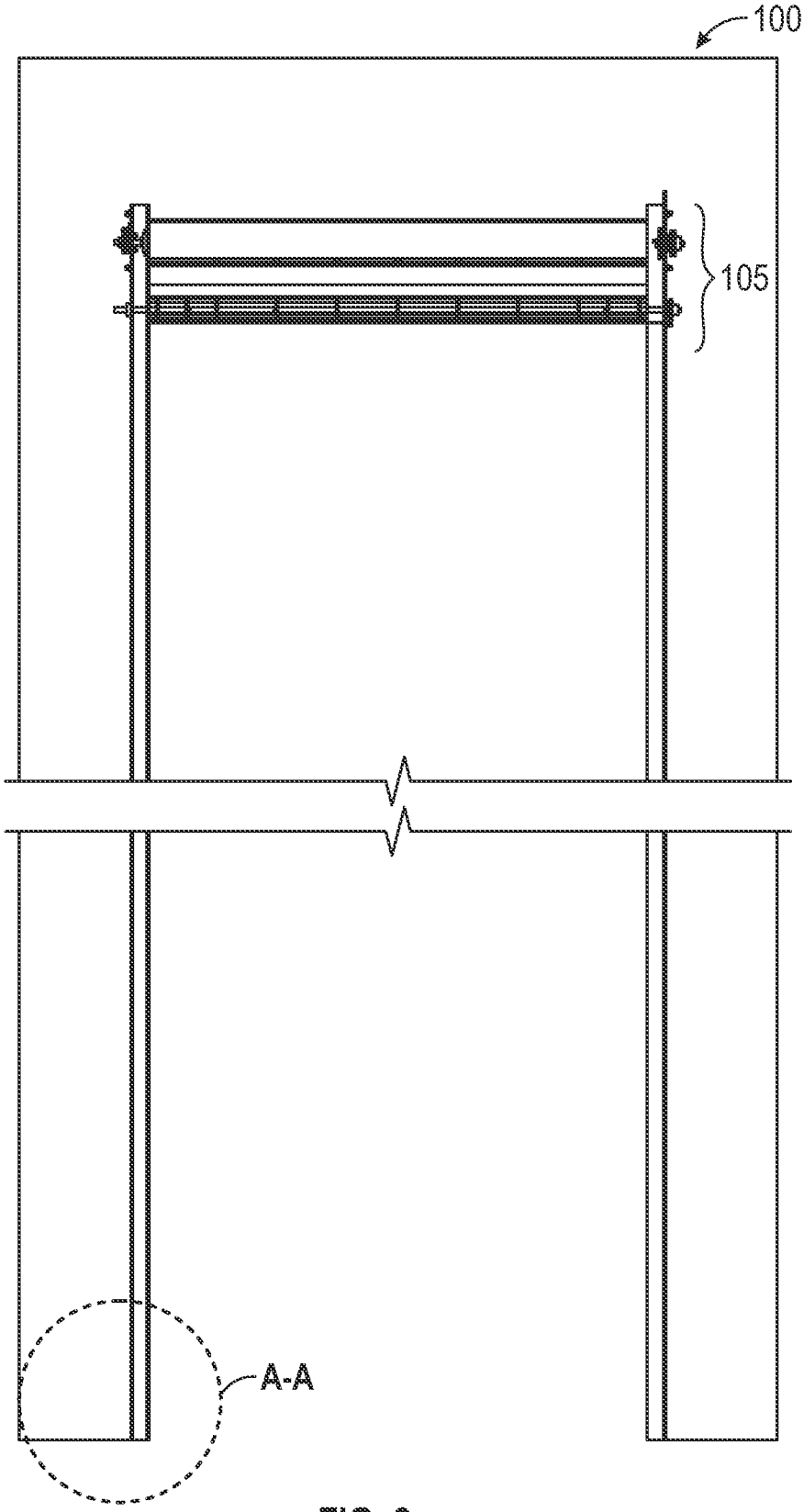
Figure 4:
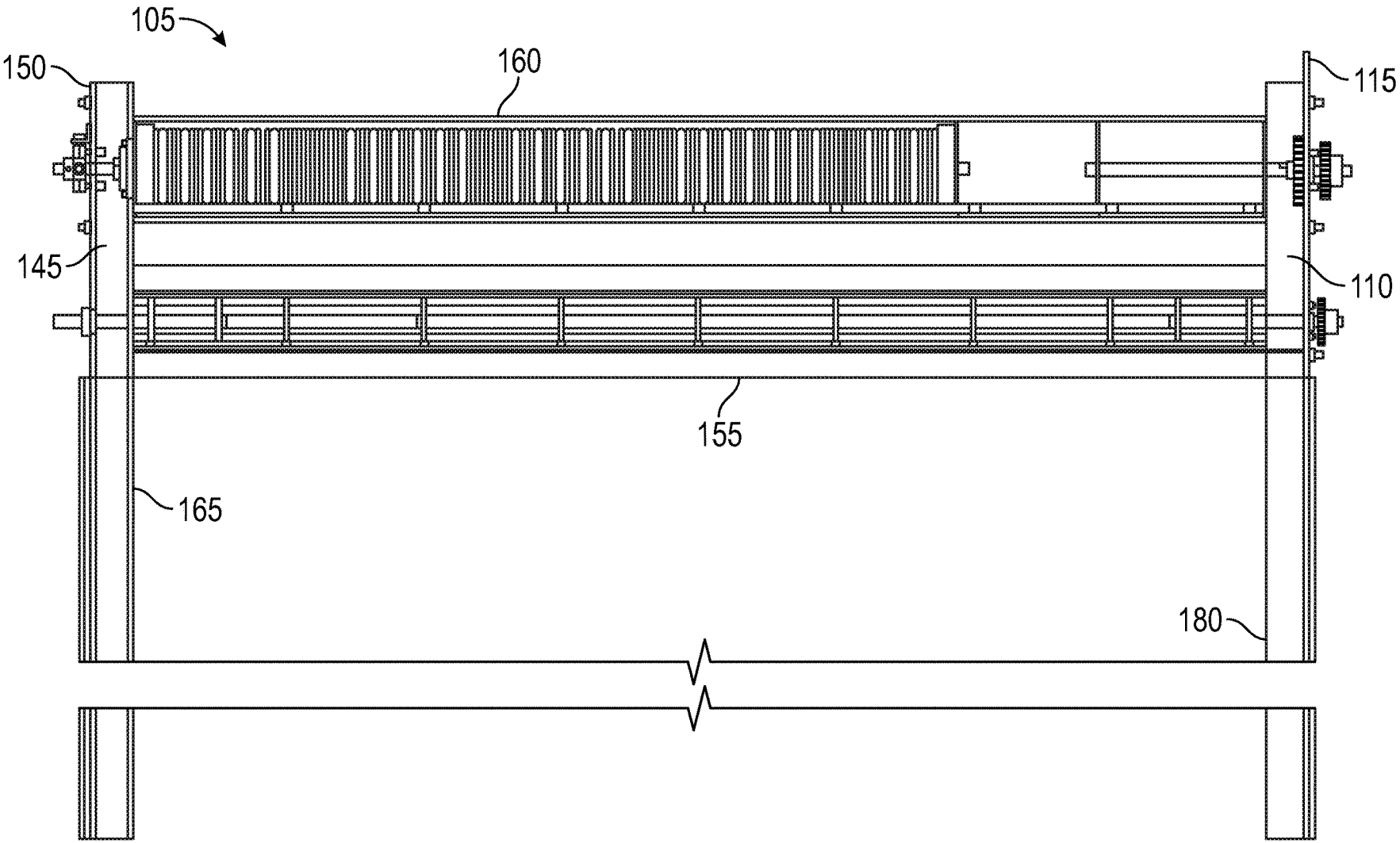
Figure 5:
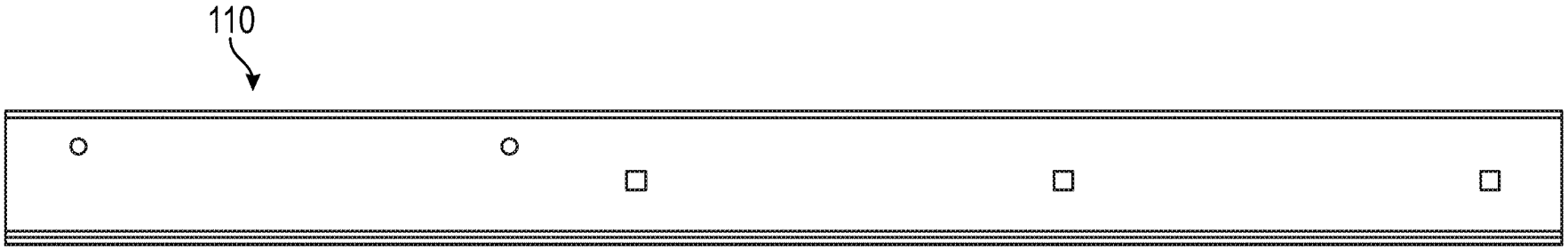
Figure 6:
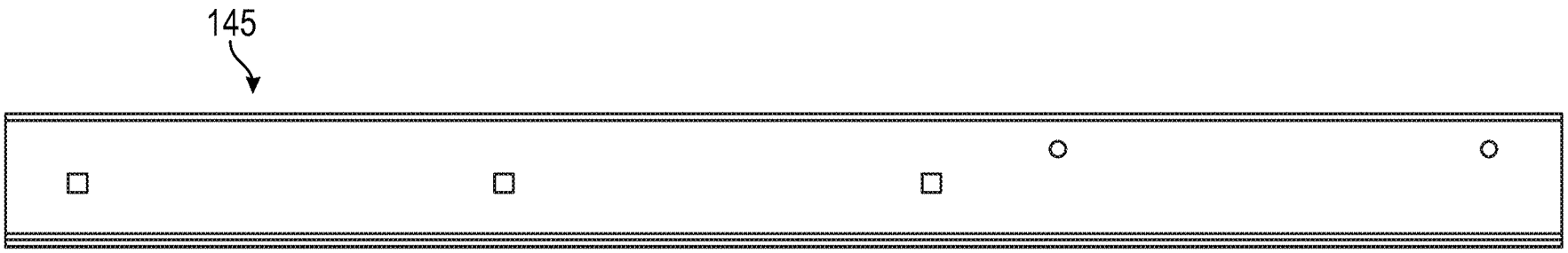

FIG. 2 shows a front view of an example of drive or main assembly 105. FIG. 3 shows a Table 107 that lists certain components of the drive or main assembly 105 shown in FIG. 2. For example, drive or main assembly 105 may include, a drive side head plate assembly 115, a Round Head, Short, Square Neck (RHSSN) bolt 120, a narrow Flat Washer (FW) 125, a regular Lock Washer (LW) 130, a Hex Jam (HJ) nut 135, a HJ nut 140, a left side (LS) 48-inch top angle 145 (shown in FIG. 6), a tension side head plate assembly 150, a brush bar assembly 155, a barrel assembly 160, a top track section 165, an a Hex bolt (H-bolt) 170, a top track section right side 175, and a guide assembly 180. FIG. 4 shows more details of drive or main assembly 105 and shows some of the components listed in Table 107.

Referring now to FIG. 7 through FIGS. 12A and B, various views of a head plate bracket assembly of the presently disclosed freezer blast cell fabric roll up door 100 are shown. Namely, the head plate bracket assembly comprises drive side head plate assembly 115 and tension side head plate assembly 150 shown in FIG. 2, FIG. 3, and FIG. 4.

Figure 7:
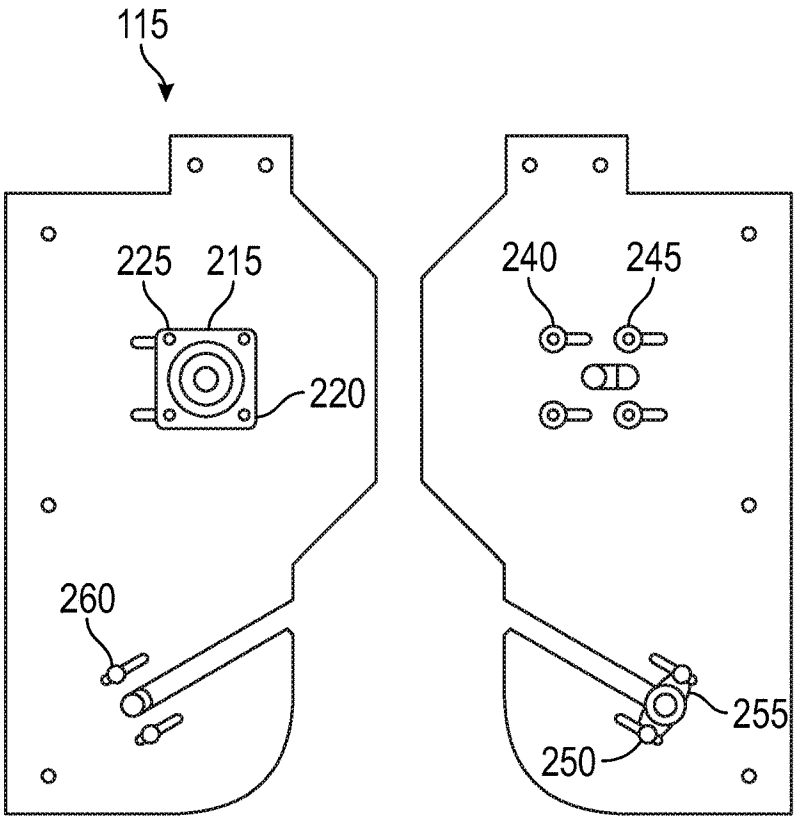
Figure 8:
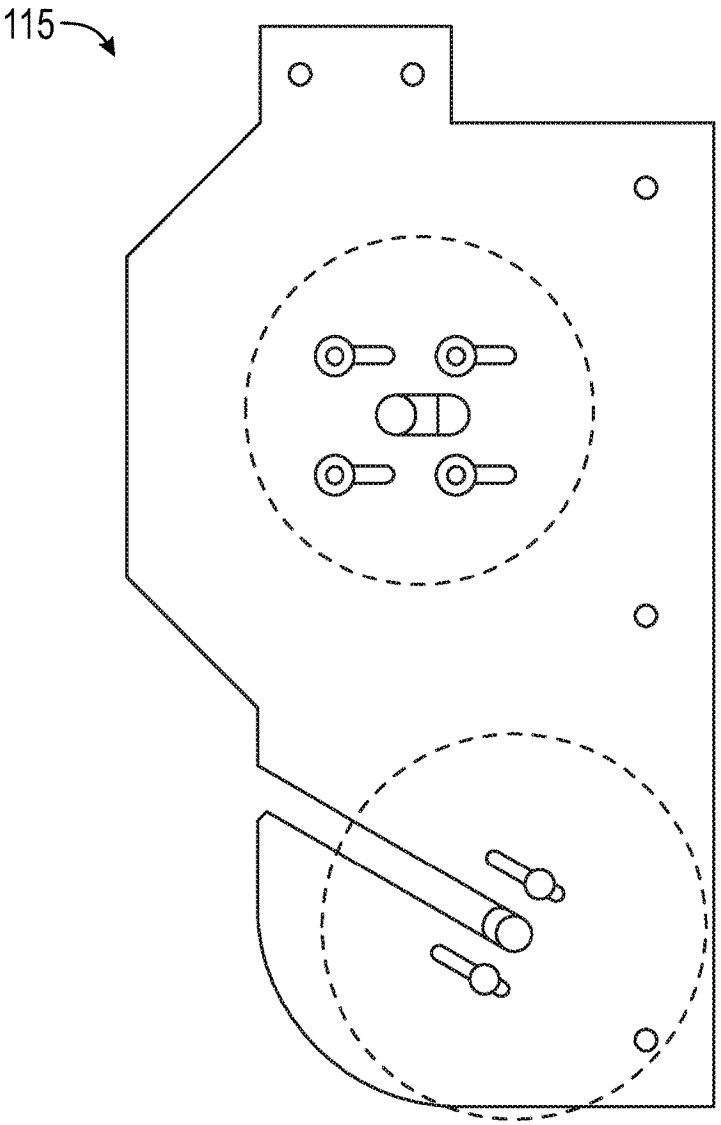
Figure 9:
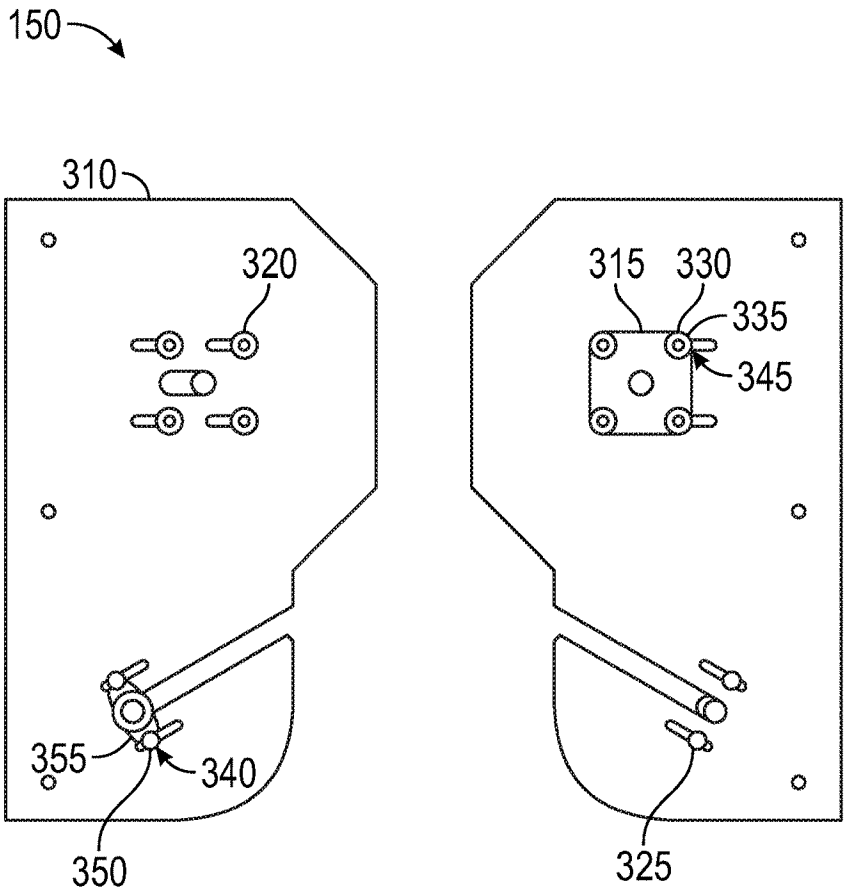
Figure 10:
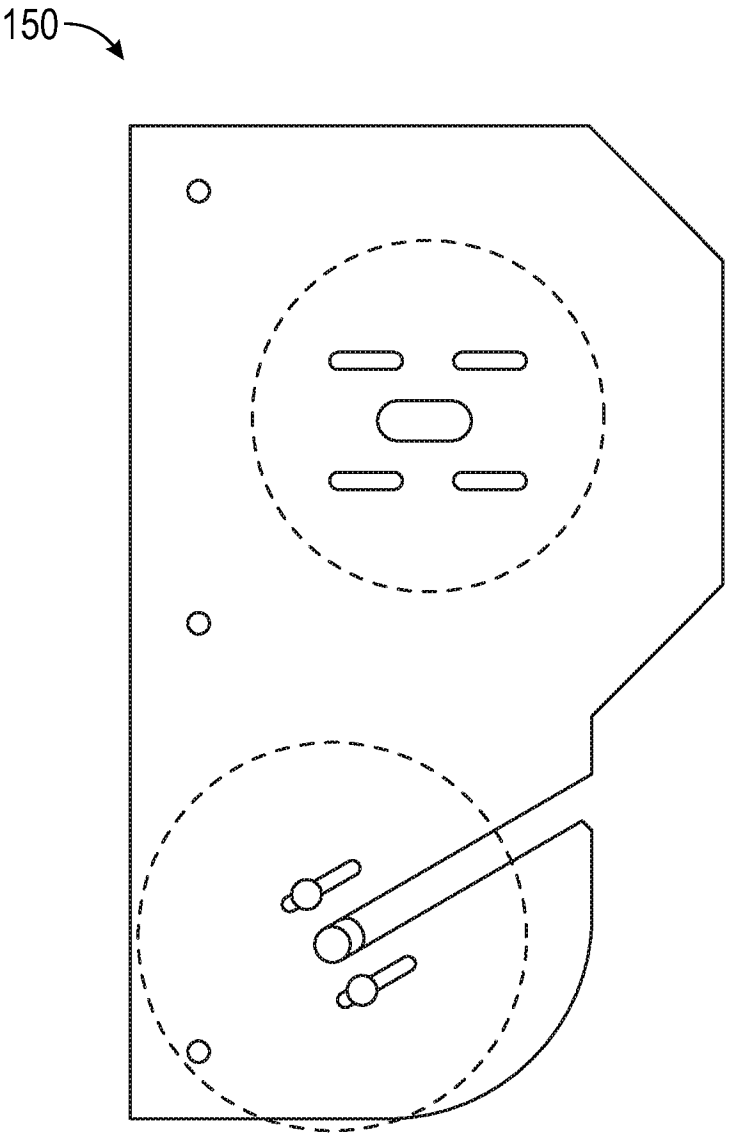
Figure 11C:
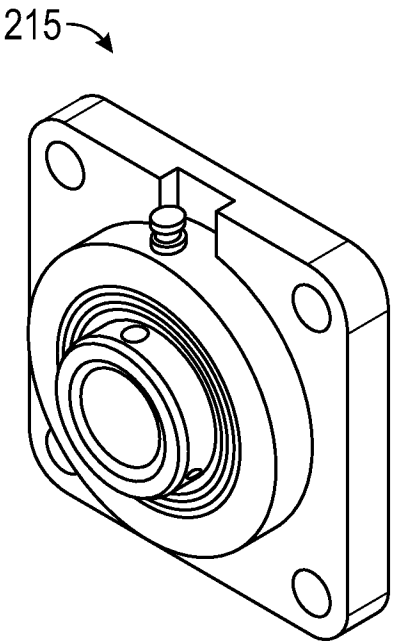
Figure 11B:
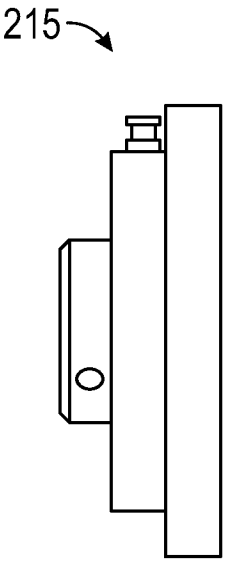
Figure 11A:
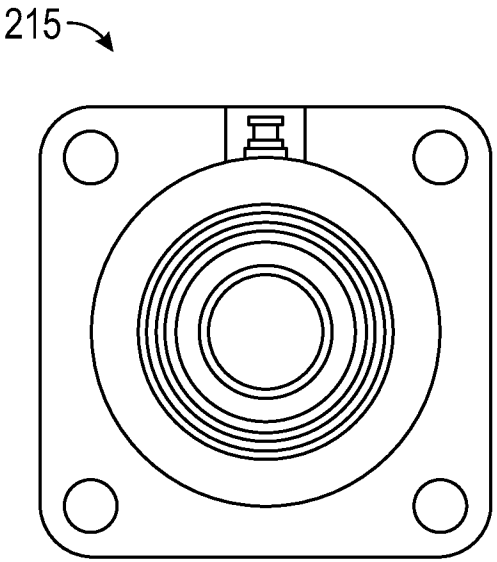
Figure 12B:
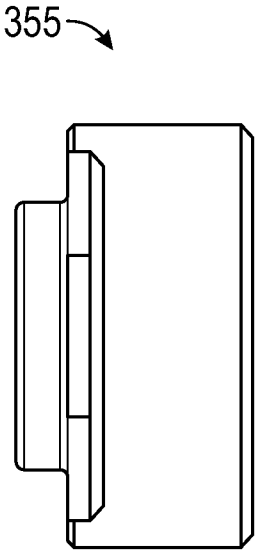
Figure 12A:
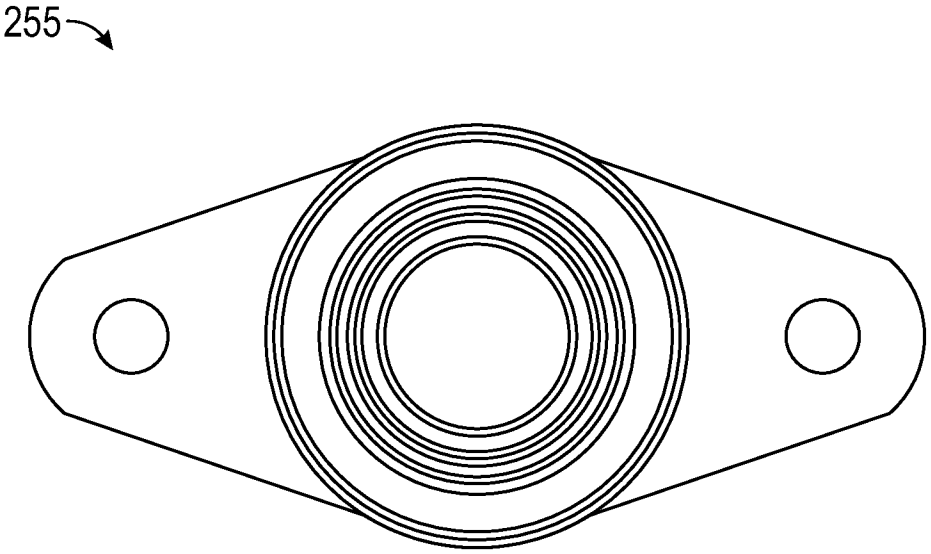
Figure 13:
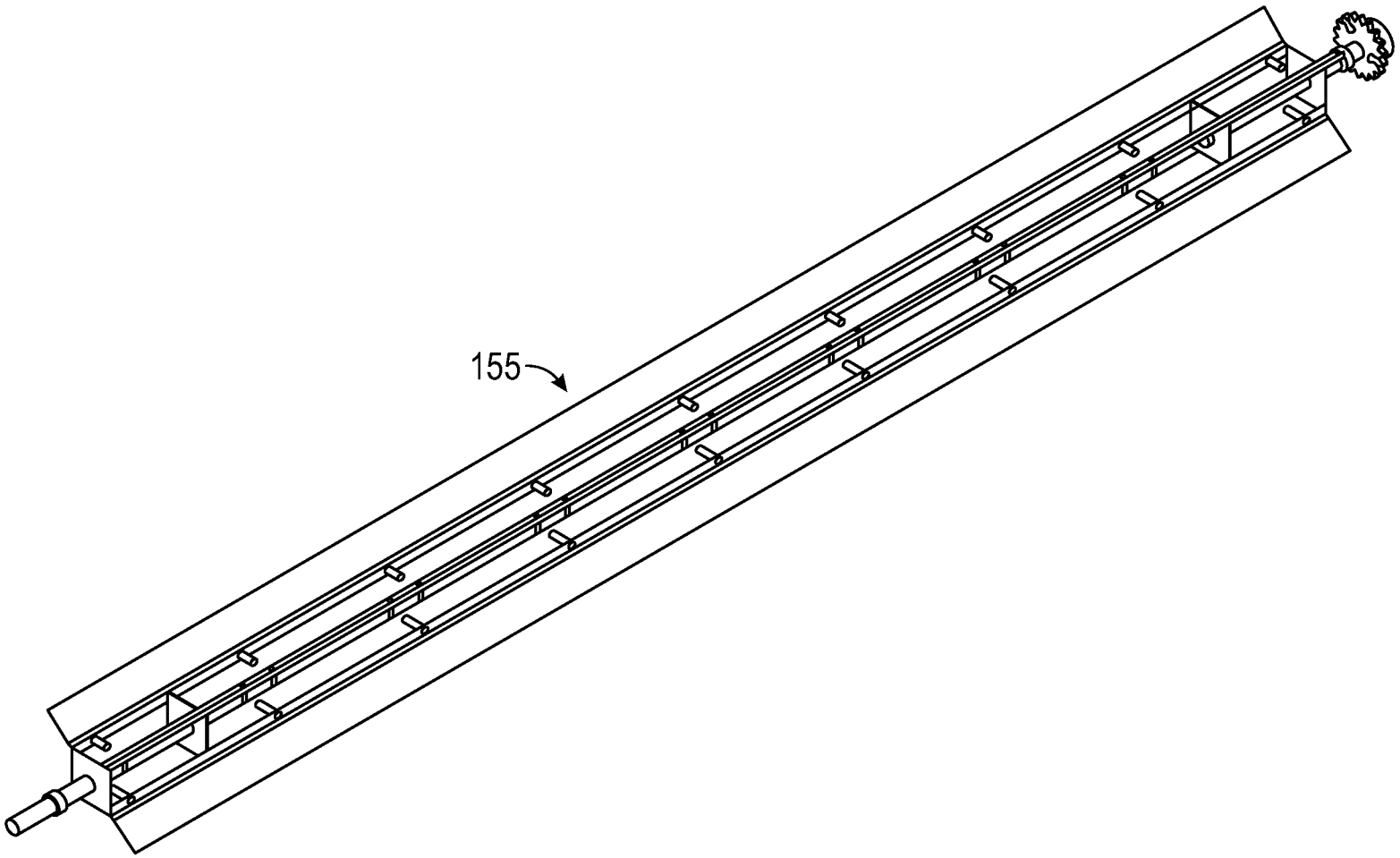
Figure 14:
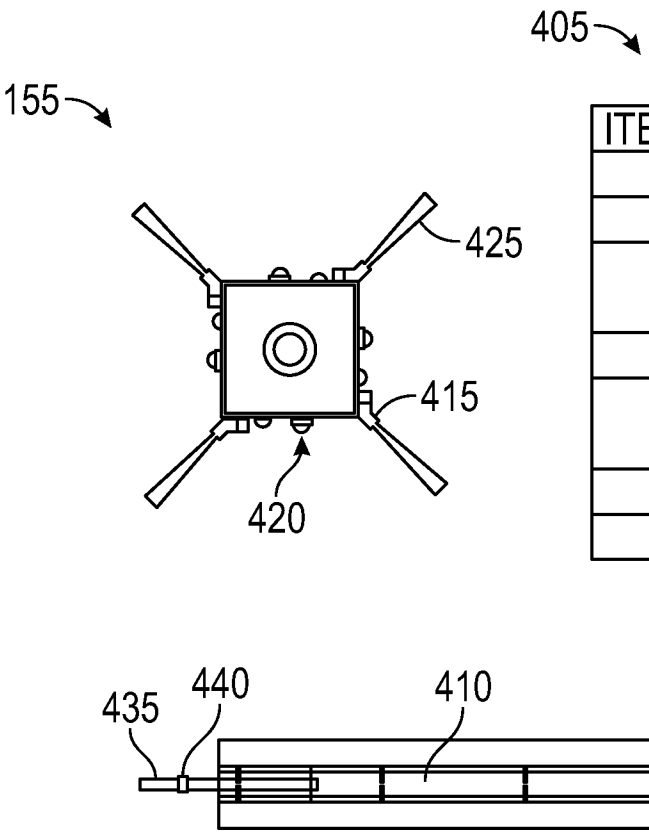

FIG. 7 and FIG. 8 show more details of drive side head plate assembly 115. Table 205 on FIG. 7 lists the components of drive side head plate assembly 115, including new head plate with chain hoist mount 210, browning bearing 215, preferred narrow Flat Washer (FW) 0.5 shown at 220, Hex Bolt (HBOLT) 0.5000-13×1.75×1.25-N shown at 225, regular Lock Washer (LW) 0.5 shown at 230, regular LW 0.375 shown at 235, Heavy Hex Jam Nut (HHJNUT) 0.5000-13-D-N shown at 240, HHJNUT 0.5000-13-B-N shown at 245, HHJNUT 0.3750-16-D-N shown at 250, one-inch (1 IN) bearing shown at 255, and Round Head Store Norfors Bolt (RHSNBOLT) shown at 260*d*. FIG. 9 and FIG. 10 show more details of tension side head plate assembly 150. Table 305 on FIG. 9 lists the components of tension side head plate assembly 150, including new head plat 310, plate for Winding Cog (WC) shown at 315, Round Head, Short, Square Neck (RHSSN) bolt 0.5-13×1.5×1.25-N shown at 320, Round Head Square Neck Bolt (RHSNBOLT) 0.375-16×1×1-N shown at 325, preferred narrow Flat Washer (FW) 0.5 shown at 330, regular Lock Washer (LW) 0.5 shown at 335, regular LW 0.375 shown at 340, Hex Head Jam Nut (HHJNUT) 0.5000-13-D-N shown at 345, HHJNUT 0.3750-16-D-N shown at 350, and one-inch (1 IN) bearing shown at 355. Further, FIG. 11 shows more details of a browning bearing 215 of drive side head plate assembly 115. FIGS. 12A and B show more details of a 1-inch bearing 255 of drive side head plate assembly 115 and a 1-inch bearing 355 of tension side head plate assembly 150.

Generally, the head plate bracket assembly is constructed from a steel plate and a steel angle. The head plate brackets are mounted to the top of the door guides. These brackets house the completed barrel, curtain, and drive assemblies. These brackets are made to a unique shape allowing for the barrel assembly to have some forward and backward adjustment to optimize clearance for the curtain as it is rolled around the barrel while being put in the up position. It also provides the slotted adjustments for the brush bar and bearing assembly.

Referring now to FIG. 13 through FIG. 18, various views of brush bar assembly 155 of the presently disclosed freezer blast cell fabric roll up door 100 are shown. Table 405 on FIG. 14 lists the components of brush bar assembly 155, including four-inch square (4 IN SQ) tube 120 IN shown at 410, brush retainer 415, Flat Head Tapping Screw (FHTS) 0.3125-12-AB-1.83-N shown at 420, brush 425, shaft assembly drive side 430, shaft assembly 435, and a set collar 9414T19 shown at 440.

Generally, brush bar assembly 155 is constructed from the following items: steel tube, steel shaft, brush seal, brush seal retainer, and fastening hardware. These items are assembled in a unique manner in which it becomes the sweep. The brush seal retainer is mounted at predetermined locations around the tube. The brush seal is then slid into the retainer creating a multisided sweep equal to the width of the curtain. This assembly has a steel shaft in each end. These shafts go through bearings that have adjustable slots located it the head plate brackets. There is a gear placed on the drive side of this shaft. This gear is attached to another gear on the drive side of the barrel assembly. These are geared in a manner in which they have a different gear ratio than the drive gear on the curtain. This allows the brush bar to spin at a higher RPM than the curtain is traveling. This is mounted so the brush is touching the curtain at all times, effectively creating the sweep that removes the excess frost that often occurs on the curtain in the harsh environment of the blast freezer. The brush bar operates every time the door is raised or lowered. Removing excess frost on each cycle prevents ice from accumulating on the door to the point where the added ice weight can affect the operation of the door. The brush bar also eliminates the need for personnel to periodically go into the freezer and manually remove this frost accumulation.

Figure 15A:
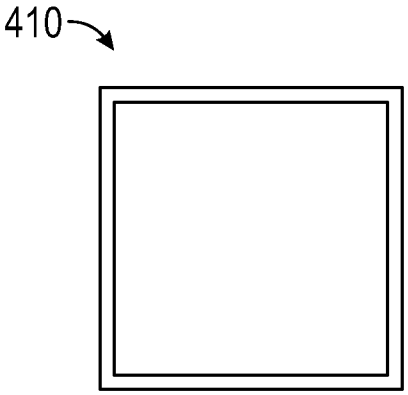
Figure 15B:
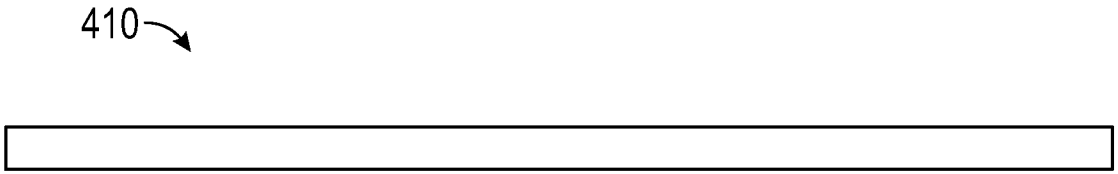
Figure 16B:
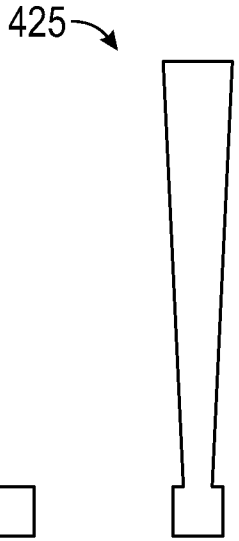
Figure 16A:
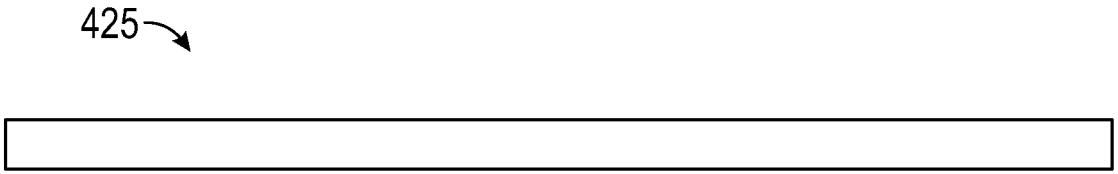
Figure 17:
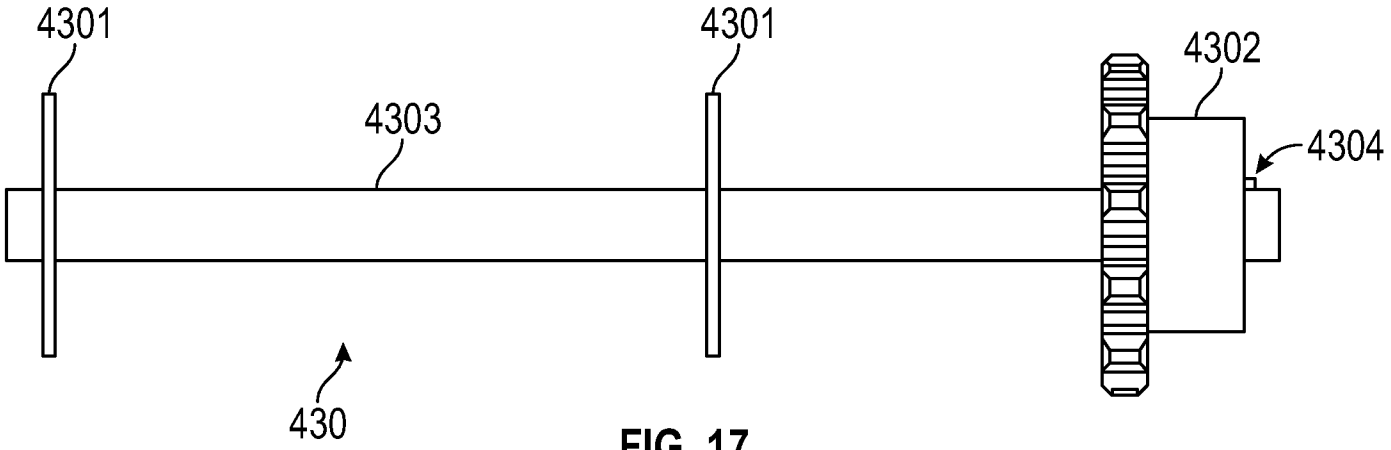
Figure 18:
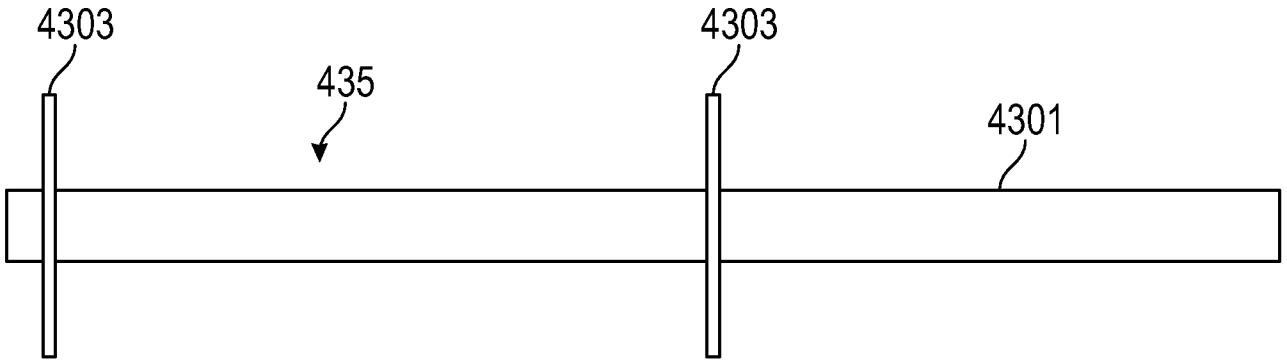
Figure 19:
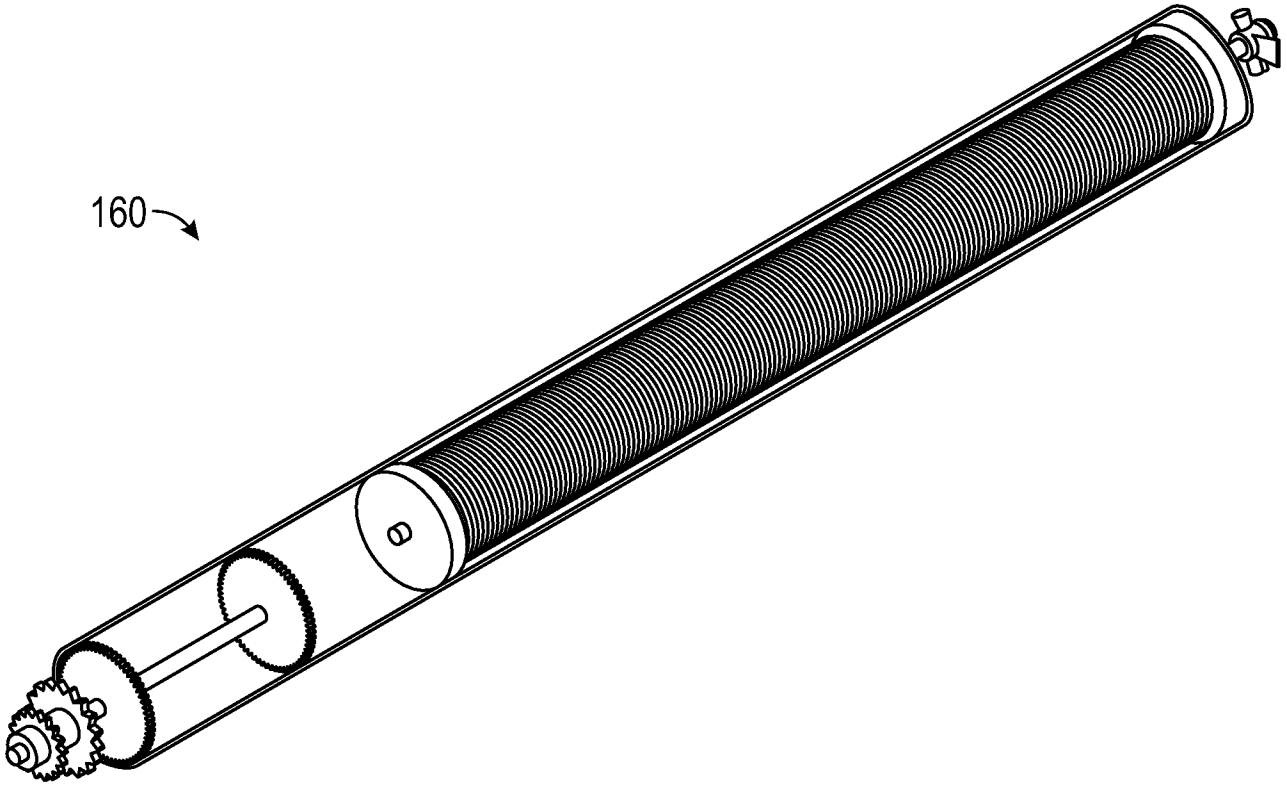
Figure 20:
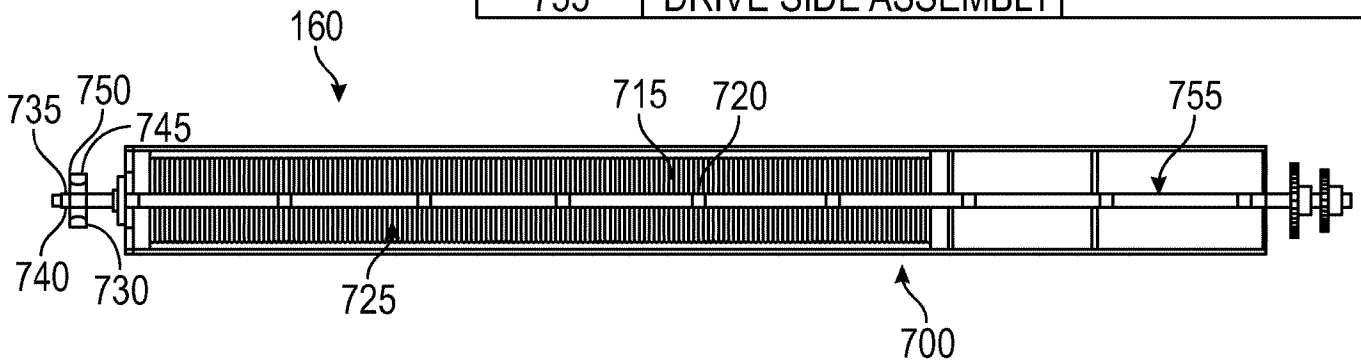

FIGS. 15A and B through FIG. 18 show examples of certain components of brush bar assembly 155. For example, FIGS. 15A and B show a 4-inch square tube 410 of brush bar assembly 155. FIGS. 16A and B show a brush 425 of brush bar assembly 155. FIG. 17 shows a drive side shaft assembly 430 of brush bar assembly 155 and a Table 505 listing the components of drive side shaft assembly 430, including brush bar inner caps 4301, finished bore sprocket 51-1.133P12T12S03.0H2.0L1.0000S1 shown at 4302, one-inch (1 IN) shaft with key way shown at 4303, and 250×2 KEY shown at 4304. FIG. 18 shows a shaft assembly 435 of brush bar assembly 155 and a Table 605 listing the components of shaft assembly 435.

Referring now to FIG. 19 through FIG. 26, various views of barrel assembly 160 of the presently disclosed freezer blast cell fabric roll up door 100 are shown. Table 705 on FIG. 20 lists the components of barrel assembly 160, including barrel 700, curtain retainer 715, Round Hex Bolt (RH- BOLT) 0.375-16×0.75×0.75-N shown at 720, spring assembly 725, winding cog 730, Hex Bolt (HBOLT) 0.3750-16×2.5×2.5-N shown at 735, Hex Jam Nut (HJNUT) 0.3750-16-N shown at 740, winding cog angle 745, winding cog angle pin 750, and drive side assembly 755.

Generally, barrel assembly 160 serves multiple functions for the roll up door. These parts are assembled in a manner in which it houses the torsion spring to act as the counter balance for the door curtain. The curtain is attached to the barrel providing a place for the curtain to wrap around while the door is being opened. It also allows it to feed uniformly into the guides as it is being closed. The barrel assembly is constructed from the following items: 10" schedule 40 steel pipe, torsion spring, torsion spring attachment plates, steel shaft for torsion spring attachment, bearing, curtain retainer, winding cog for adding tension to torsion spring, drive side shaft, drive side shaft collars, and hardware.

Figure 21B:
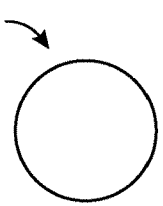
Figure 21A:
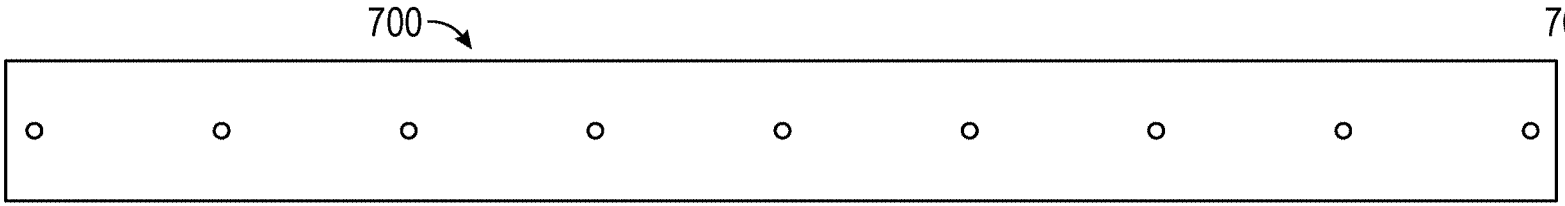
Figure 22:
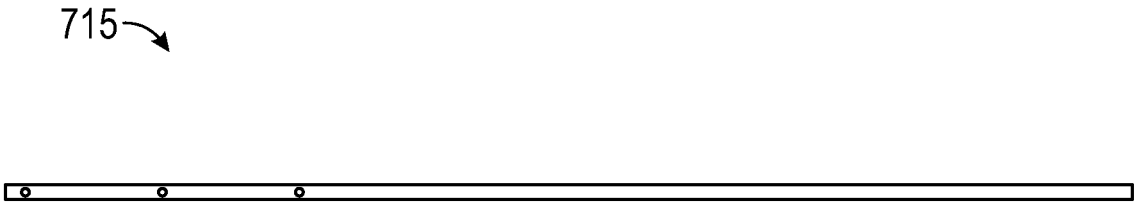
Figure 23:
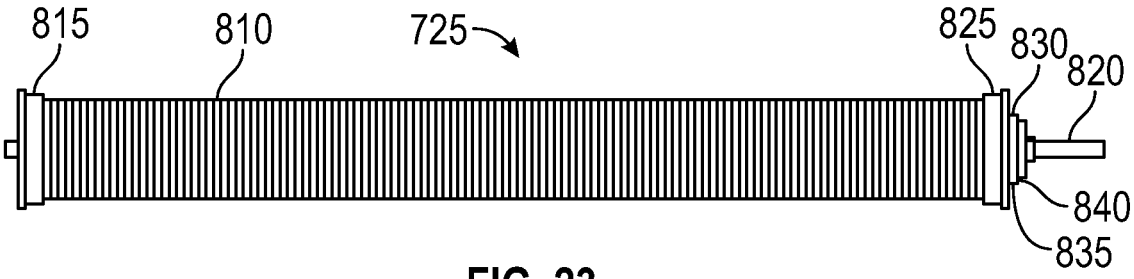
Figure 24C:
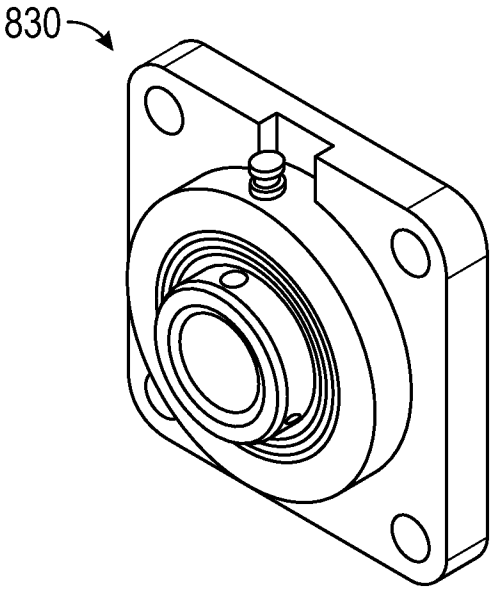
Figure 24B:
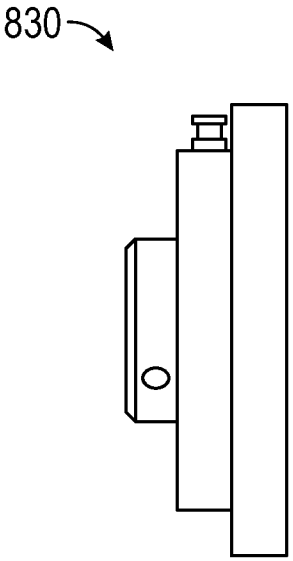
Figure 24A:
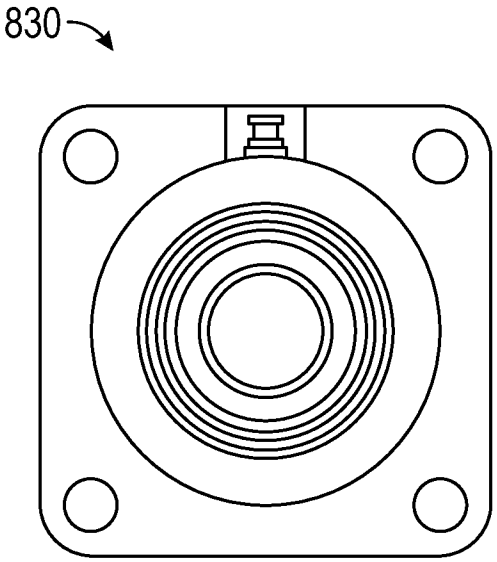
Figure 25A:
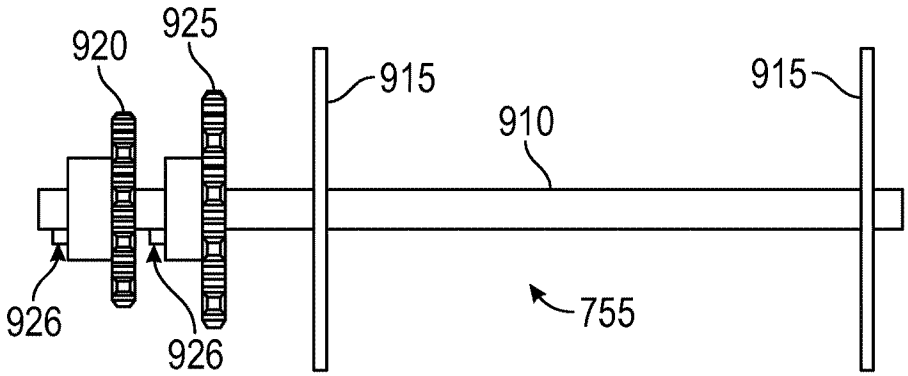
Figure 25B:
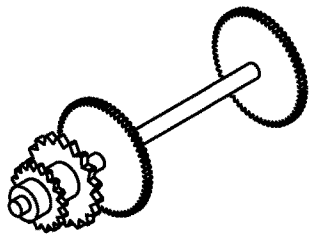
Figure 26:
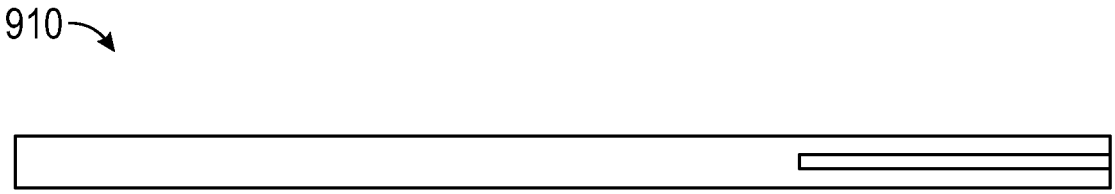
Figure 27:
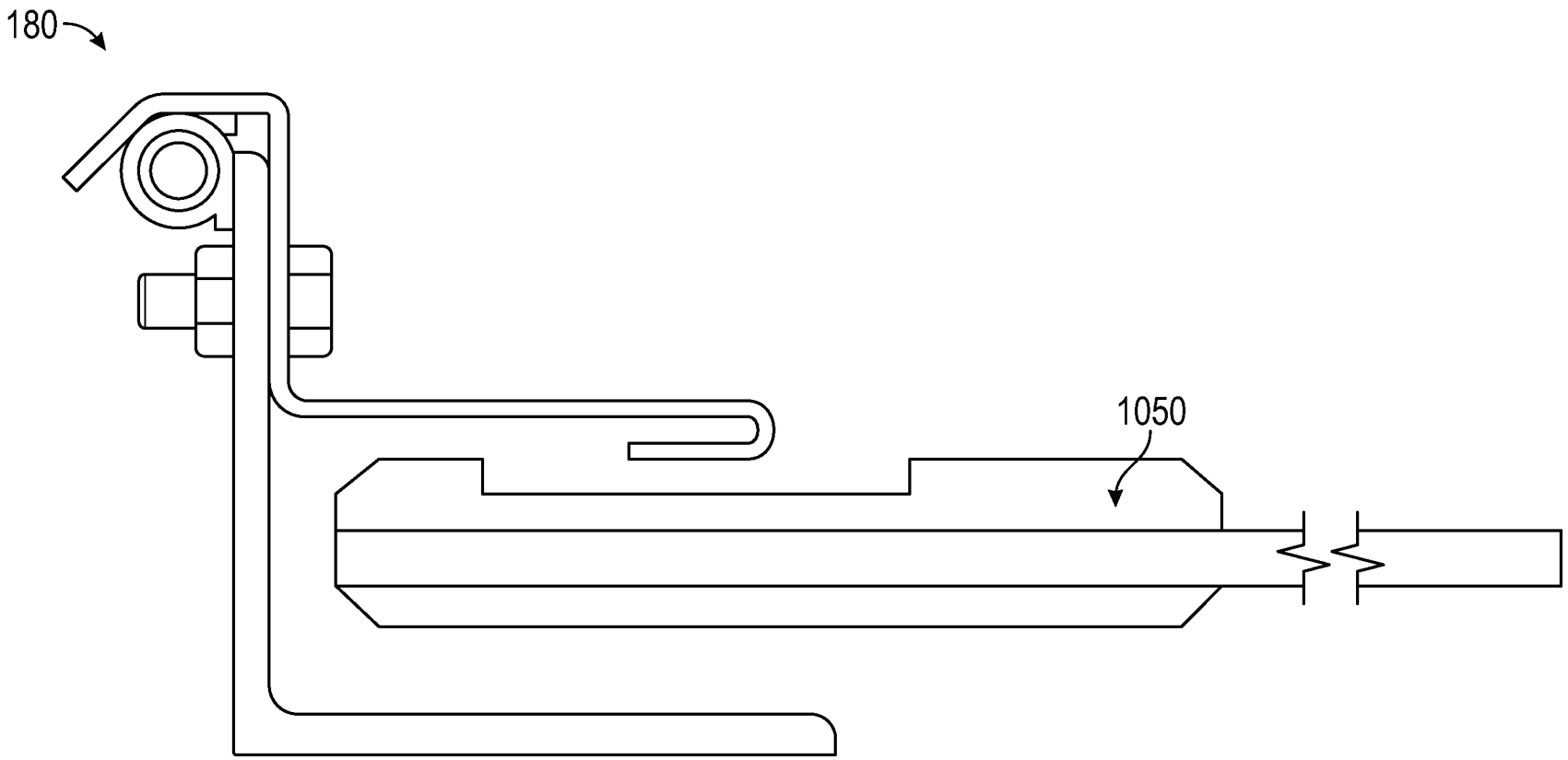
Figure 28A:
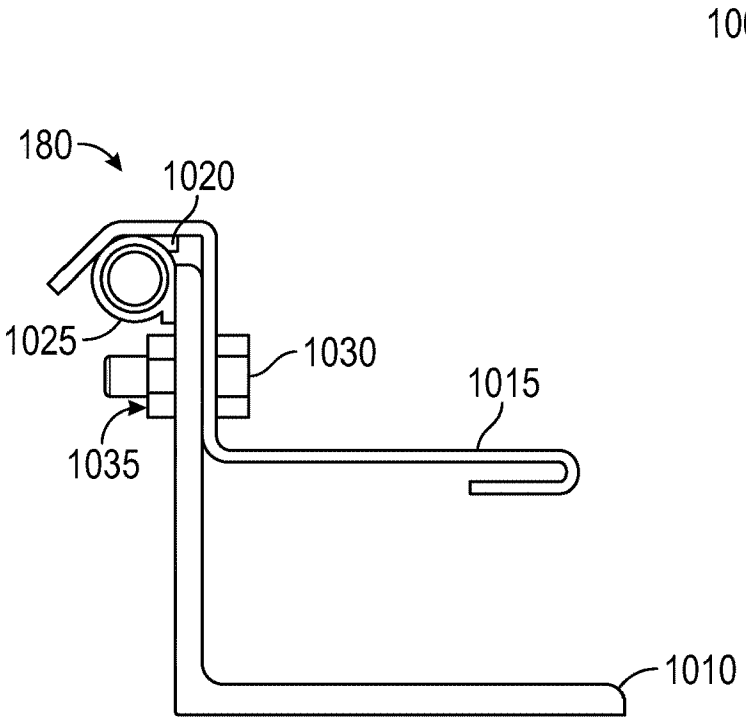
Figure 28B:
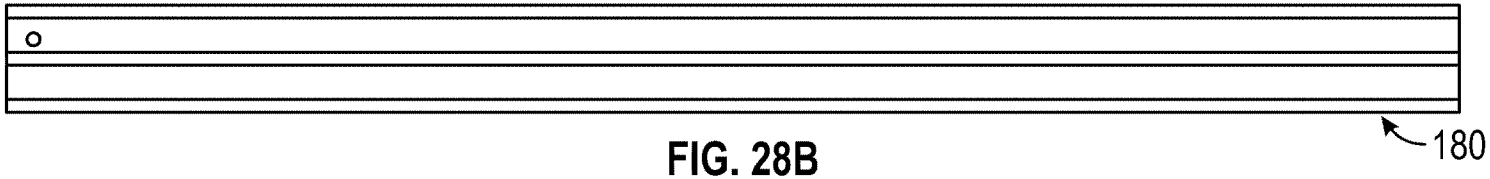

FIGS. 21A and B through FIG. 26 show examples of certain components of barrel assembly 160. For example, FIGS. 21A and B show a barrel 700 of barrel assembly 160. FIG. 22 shows a curtain retainer 715 of barrel assembly 160. FIG. 23 shows a spring assembly 725 of barrel assembly 160 and a Table 805 listing the components of spring assembly 725, including torsion spring 810, spring plate 815, tension side shaft 820, barrel end cap tension side 825, browning bearing 830, regular Lock Washer (LW) 0.5 shown at 835, Hex Bolt (HBOLT) 0.5000-13×0.5×0.5-N shown at 840. FIGS. 24A-C show a browning bearing 830 of spring assembly 725 of barrel assembly 160. FIGS. 25A and B show a drive side assembly 755 of barrel assembly 160 and a Table 905 listing the components of drive side assembly 755, including drive side shaft 910, barrel end plate 915, finished bore sprocket 51-1.133P15T15S03.0H2.0L1.2500S1 shown at 920, finished bore sprocket 51-1.133P20T20S03.0H2.0L1.250051 shown at 925, and 0.250×2 KEY shown at 926. FIG. 26 shows a drive side shaft 910 of drive side assembly 755 of barrel assembly 160.

Referring now to FIG. 27 through FIG. 32, various views of guide assembly 180 of the presently disclosed freezer blast cell fabric roll up door 100 are shown. Table 1005 on FIGS. 28A and B list the components of guide assembly 180, including rear guide angle 1010, guide face 1015, hinge body 1020, hinge base assembly 1025, Hex Bolt (HBOLT) 0.3750-16×1×1-N shown at 1030, and Hex Jam Nut (HJNUT) 0.750-16 D-N shown at 1035.

Generally, guide assembly 180 is constructed from the following items: structural steel angle, computer numerically controlled (CNC) formed steel sections for guide face, bottom bar lock down feature, steel barrel hinges, assembly hardware. The guide assembly is the foundation for this door. All brackets and components are bolted to these guides. These guides consist of structural angles placed on each side of the opening at a predetermined distance running parallel with one another. The head plates that house the rest of the door are then bolted to these guides. The structural wall angle has separable barrel hinges welded in predetermined locations to accept the CNC formed steel guide face. These are formed in five foot sections that are hinged onto the structural wall angles. This allows for quick easy access to any point on the curtain if it were to require maintenance. These sections are kept in the closed position with two bolts. One near the top of each section and one near the bottom of each section. These sections are hinged in a manner that allows them to be pivoted out of the way or lifted entirely off the barrel hinge.

The CNC formed guide face sections are what hold the curtain in the opening while the door is in the closed position. These are formed pieces that incorporate the locking edge that works with the wind locks 1050 located on the major cross members of the curtain. This formed edge on the steel guide face is what the wind lock 1050 engages when force is applied.

Additionally, a unique hold down feature in the bottom of the guides prevents the bottom bar from being pulled up during any significant amount of wind load. The hold down feature includes half-round pieces of ultrahigh molecular weight (UHMW) plastic bolted at a predetermined location near the bottom of each guide assembly. This unique design allows the curtain to pass and raise above it automatically when there is no wind load on the curtain (i.e. while the curtain is in the relaxed position with the blast cell fans turned off). While the door is in the closed position and force is applied from either side of the opening it forces the bottom bar assembly to lock underneath the half-round UHMW preventing it from lifting the bottom bar to an unacceptable height. Without the hold down feature, the curtain acts as a wind sail undesirably lifting the bottom bar off the ground.

Figure 29A:
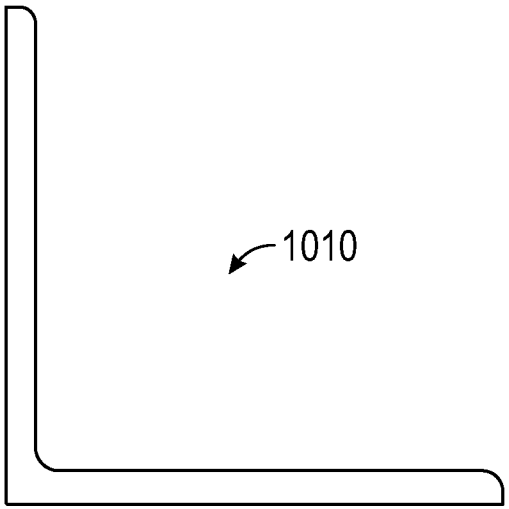
Figure 29B:
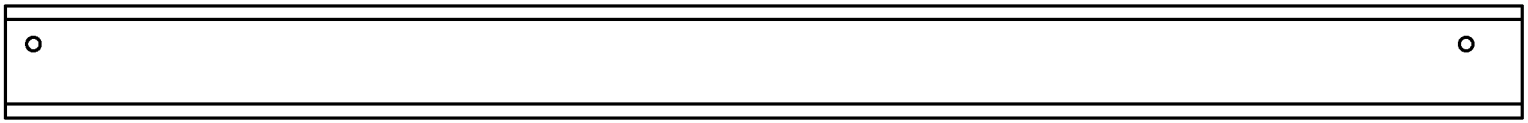
Figure 30A:
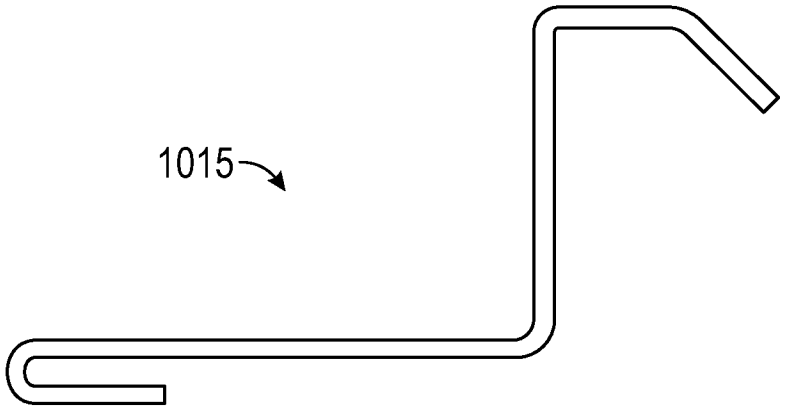
Figure 30B:
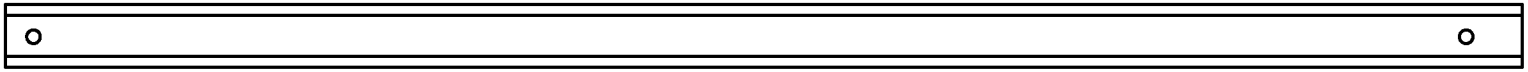
Figure 31A:
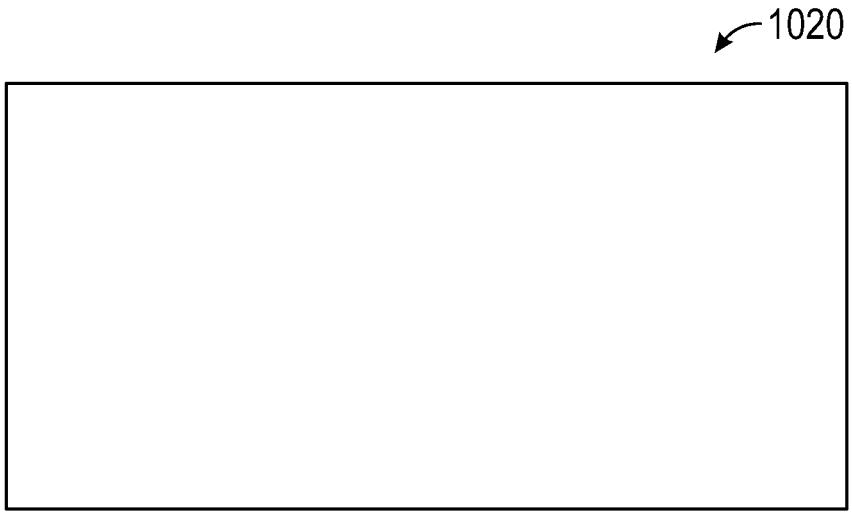
Figure 31B:
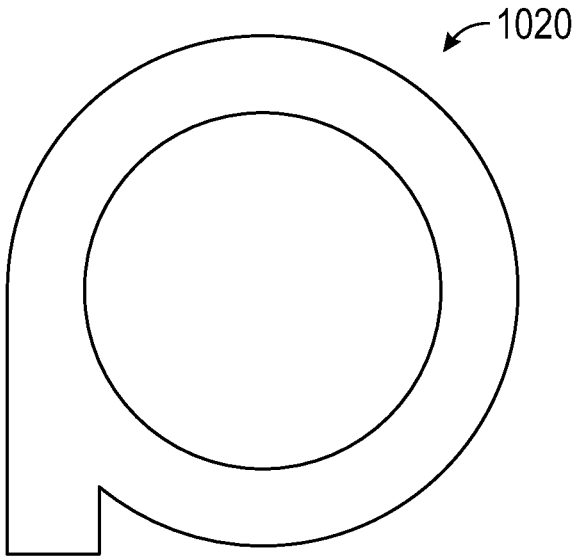
Figure 32B:
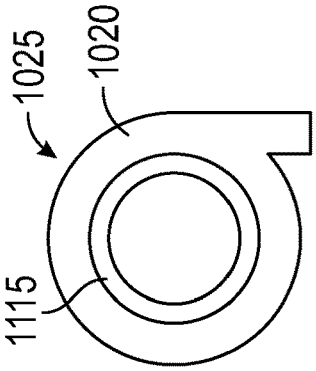
Figure 32A:
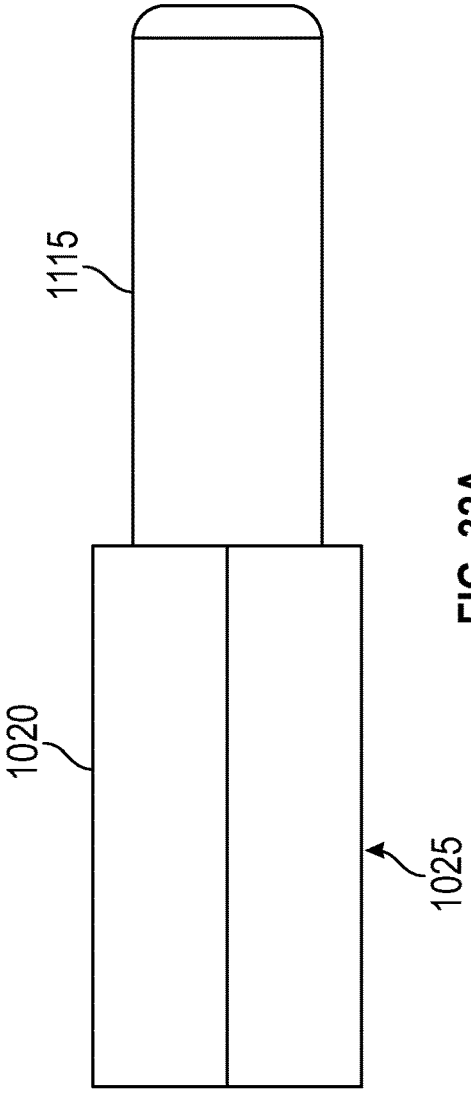

FIGS. 29A and B through FIGS. 32A and B show examples of certain components of guide assembly 180. For example, FIGS. 29A and B show a rear guide angle 1010 of guide assembly 180. FIGS. 30A and B show a guide face 1015 of guide assembly 180. FIGS. 31A and B show a hinge body 1020 of guide assembly 180. FIGS. 32A and B show a hinge base assembly 1025 of guide assembly 180 and a Table 1105 listing the components of hinge base assembly 1025.

The curtain assembly 50 of the presently disclosed freezer blast cell fabric roll up door 100 is constructed from the following items: fabric meeting the strength and freeze requirements for use in a blast freezer, aluminum cross members (major stiffeners), fiberglass cross members (minor stiffeners), wind lock tabs, wear tabs, bottom bar, and assembly hardware. The curtain creates the actual barrier between the freezer blast cell and the freezer environment they are generally housed in. The curtain attaches to the barrel and is then able to be raised and lowered into the opening creating the barrier.

The curtain is constructed from suitable fabrics meeting the requirements to withstand the negative temperature and retain the flexibility characteristics and strength qualities required of flexible blast freezer doors. The curtain includes horizontal pockets 190 at predetermined distances that span the width of the curtain (see FIGS. 1, 34A and B and 35B). These horizontal pockets 190 allow for the major and minor stiffeners to be placed across the curtain. The major stiffeners then receive the wind locks and wear tabs which are through bolted through each end of the major stiffeners opposing each other. The wind locks and wear tabs ride partially in the guide and partially out of the guide. This helps combat any wear points on the curtain as it travels open and closed.

The front tab serving as the wind lock is machined in a unique manner in which it is able to lock onto the inside edge of the formed locking section of the guide. This wind lock allows the curtain to have a certain amount of flexibility in either direction depending on positive or negative air flow being produced by the freezing process. Once the curtain flexes to a certain point, the wind locks engage on the locking edge formed inside the guide preventing it from coming out any further. This prevents the curtain assembly 50 from being forced completely out of the guides due to the extremely high wind loads generated during the blast cycle.

Then, once the blast cycle is complete, the curtain may relax back into the guide position and further allowing the door to be put in the open position.

Additionally, a bottom bar 185 is placed on the lower edge of the curtain to add rigidity and weight to the leading edge of the fabric (see FIGS. 34A and B, and 35A). The weight of the bottom bar 185 assists in balancing the curtain with the torsion spring. The tension created in the fabric by the weight of the bottom bar 185 aids in the travel of the door in each direction (i.e. opening direction and closing direction). The bottom bar 185 usually consists of two opposing angle bars bolted through the fabric forming a flat surface across the bottom of the curtain to close against the floor. The vertical legs of the bottom bar 185 that are through bolted through the fabric aid in the unique lock down feature placed in the bottom of the guide assembly.

FIG. 33A shows a perspective view of one corner of the lower portion of the frame of the guide assembly 180. For example, FIG. 33A shows the lower portion of the guide assembly 180 abutting at about a 90 degree angle with a bottom bar 185, as shown. A first guide rail 1010 and a second guide rail 1015 are arranged on edge along the length of the bottom bar 185, as shown. A half-round catch block 1225 is provided on the face of the first guide rail 1215 that is facing the second guide rail 1220 and near the guide assembly 180. A wear tab 1230 is provided on the face of the guide assembly 180 and abutting the bottom bar 185. In one example, the half-round catch block 1225 is about 3.5 inches long and about 1.25 inches wide. In one example, the wear tab 1230 is about 2 inches square and is about 0.25 inches thick. Let it be noted that the other corner of the lower portion of the frame of the guide assembly 180, which is not shown, likewise includes a half-round catch block 1225. Further, any number of the half-round catch blocks 1225 can be provided along the length of the first guide rail 1010. Additionally, in another example the half-round catch blocks 1225 can be provided on the second guide rail 1015 instead of the first guide rail 1010. FIG. 33B shows detail of the left side guide assembly without bottom bar 185.

The half-round catch blocks 1225 provide a stop mechanism for the curtain. Namely, the bottom bar 185 on the lower edge of the curtain falls in under the half-round catch blocks 1225 when the curtain is lowered (see FIGS. 34A and 35A). The wind load causes the bottom bar 185 to go under the half-round catch blocks 1225, locking the curtain in the down position. The number and locations of the half-round catch blocks 1225 may depend on the wind direction. For example, while FIGS. 33A and B show the half-round catch blocks 1225 on the inner face of the first guide rail 1010 for opposite wind direction the half-round catch blocks 1225 can be placed on the second guide rail 1015.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A freezer blast door assembly comprising:

a drive assembly;

a head plate bracket assembly;

a brush bar assembly;

a barrel assembly;

a guide assembly; and a curtain assembly including a curtain having at least one horizontal pocket and a bottom bar assembly at a lower end of the curtain; a stiffener bar in each at least one horizontal pocket, the stiffener bar including two ends each comprising a wind lock; the curtain being movable between an open position and a closed position;

wherein the guide assembly further comprises:

a formed edge sized to interlock with the at least one wind lock on the curtain assembly when the curtain assembly is in the closed position and a wind load is applied; and a hold down feature at a bottom portion of the guide assembly, the bottom bar assembly being disposed entirely beneath the hold down feature when the curtain is in the closed position, the hold down feature configured to allow the curtain to pass automatically when the wind load is not applied, and preventing the curtain from moving out of the closed position when the wind load is applied;

wherein, when the curtain assembly is moving between the open position and closed position, the brush bar assembly rotates to brush off the curtain before the curtain rolls into the barrel assembly.

2. The door assembly of claim 1, wherein the brush bar assembly comprises one or more brushes coupled to a bar, wherein the one or more brushes have a width substantially equal to a width of the curtain assembly, and further wherein when the curtain assembly is opened or closed at a speed, the one or more brushes of the brush bar assembly rotate at a greater speed than the speed of the curtain assembly.

3. The door assembly of claim 2, wherein the barrel assembly further comprises a torsion spring coupled to the curtain assembly such that the torsion spring counterbalances the curtain assembly to ease raising and lowering the curtain assembly.

4. The door assembly of claim 2, wherein the hold down feature comprises a first guide rail and a second guide rail arranged on edge;

wherein half-round catch blocks are provided at a lower portion on a face of the first guide rail or the second guide rail; and wherein the bottom bar assembly of the curtain assembly extends under the half-round catch blocks when the curtain assembly is lowered into the hold down feature, and wherein the wind load causes the bottom bar assembly to move under the half-round catch blocks to lock the curtain assembly in the closed position.

5. A freezer blast door assembly comprising:

a drive assembly;

a head plate bracket assembly;

a brush bar assembly;

a barrel assembly;

a guide assembly; and a curtain assembly including a curtain and a bottom bar assembly at a lower end of the curtain;

the curtain being movable between an open position and a closed position;

wherein the guide assembly further comprises a hold down feature sized to receive the bottom bar assembly of the curtain assembly entirely therebeneath, the hold down feature configured to allow the curtain to pass automatically when the wind load is not applied, and preventing the curtain assembly from moving out of the closed position when a wind load is applied;

wherein, when the curtain assembly is moving between the open position and closed position, the brush bar assembly rotates to brush off the curtain before the curtain rolls into the barrel assembly.

6. A freezer blast door assembly comprising:

a drive assembly;

a head plate bracket assembly;

a brush bar assembly;

a barrel assembly;

a guide assembly; and a curtain assembly including a curtain and a bottom bar assembly at a lower end of the curtain; the curtain being movable between an open position and a closed position;

wherein the guide assembly further comprises:

a hold down feature sized to receive the bottom bar assembly of the curtain assembly; the bottom bar assembly being disposed entirely beneath the hold down feature when the curtain is in the closed position; the hold down feature configured to allow the curtain to pass automatically when the wind load is not applied, and preventing the curtain assembly from moving out of the closed position when a wind load is applied;

wherein the curtain assembly is opened or closed at a speed, and wherein the brush bar assembly rotates at a greater speed than the speed of the curtain assembly.

7. The door assembly of claim 5, wherein the brush bar assembly comprises one or more brushes coupled to a bar, wherein the one or more brushes have a width substantially equal to a width of the curtain assembly, and further wherein when the curtain assembly is opened or closed at a speed, the one or more brushes of the brush bar assembly rotate at a greater speed than the speed of the curtain assembly.

8. The door assembly of claim 5, wherein the barrel assembly further comprises a torsion spring coupled to the curtain assembly such that the torsion spring counterbalances the curtain assembly to ease raising and lowering the curtain assembly.

9. The door assembly of claim 5, wherein the hold down feature comprises a first guide rail and a second guide rail arranged on edge;

wherein half-round catch blocks are provided at a lower portion on a face of the first guide rail or the second guide rail; and wherein the bottom bar assembly of the curtain assembly extends under the half-round catch blocks when the curtain assembly is lowered into the hold down feature, and wherein the wind load causes the bottom bar assembly to move under the half-round catch blocks to lock the curtain assembly in the closed position.

10. The door assembly of claim 6, wherein the brush bar assembly comprises one or more brushes coupled to a bar, wherein the one or more brushes have a width substantially equal to a width of the curtain assembly, and further wherein when the curtain assembly is opened or closed at a speed, the one or more brushes of the brush bar assembly rotate at a greater speed than the speed of the curtain assembly.

11. The door assembly of claim 6, wherein the barrel assembly further comprises a torsion spring coupled to the curtain assembly such that the torsion spring counterbalances the curtain assembly to ease raising and lowering the curtain assembly.

12. The door assembly of claim 6, wherein the hold down feature comprises a first guide rail and a second guide rail arranged on edge;

wherein half-round catch blocks are provided at a lower portion on a face of the first guide rail or the second guide rail; and wherein the bottom bar assembly of the curtain assembly extends under the half-round catch blocks when the curtain assembly is lowered into the hold down feature, and wherein the wind load causes the bottom bar assembly to move under the half-round catch blocks to lock the curtain assembly in the closed position.

* * * * *